US007258967B1

(12) United States Patent
Sakizadeh et al.

(10) Patent No.: US 7,258,967 B1
(45) Date of Patent: Aug. 21, 2007

(54) PHOTOTHERMOGRAPHIC MATERIALS CONTAINING PRINT STABILIZERS

(75) Inventors: Kumars Sakizadeh, Woodbury, MN (US); Kui Chen-Ho, Woodbury, MN (US); Bryan V. Hunt, Fridley, MN (US); Lilia P. Burleva, Maplewood, MN (US)

(73) Assignee: Carestream Health, Inc., Rochester, NY (US)

( * ) Notice: Subject to any disclaimer, the term of this patent is extended or adjusted under 35 U.S.C. 154(b) by 0 days.

(21) Appl. No.: 11/550,461

(22) Filed: Oct. 18, 2006

(51) Int. Cl.
*G03C 5/16* (2006.01)
*G03C 1/498* (2006.01)

(52) U.S. Cl. ..... 430/350; 430/523; 430/619

(58) Field of Classification Search ..... 430/619, 430/523, 350
See application file for complete search history.

(56) References Cited

U.S. PATENT DOCUMENTS 4,571,605 A * 2/1986 Motosugi et al. ..... 503/216
5,401,699 A * 3/1995 Ohashi et al. ..... 503/217
5,804,528 A 9/1998 Aoki et al.
6,245,499 B1 * 6/2001 Suzuki et al. ..... 430/619
6,645,714 B2 11/2003 Oya et al.
2006/0141403 A1 6/2006 Ramsden et al.

FOREIGN PATENT DOCUMENTS

| | | |
|---|---|---|
| EP | 0 618 082 | 1/1998 |
| EP | 1 080 939 | 3/2001 |
| JP | 1999-078249 | 3/1999 |
| JP | 2001-068239 A | 3/2001 |
| JP | 2001-260541 A | 9/2001 |
| JP | 2001-260544 A | 9/2001 |
| JP | 2001-270247 A | 10/2001 |
| JP | 2002-274048 A | 9/2002 |
| JP | 2003-089270 A | 3/2003 |

OTHER PUBLICATIONS

U.S. Appl. No. 11/351,773, filed Feb. 10, 2006, titled "Photothermographic Materials Incorporating Arylboronic Acids", by K. Chen-Ho, et al.

* cited by examiner

*Primary Examiner*—Thorl Chea

(57) ABSTRACT

Incorporating a sulfonyldiphenol compound into photothermographic materials improves Raw Stock Keeping and post-processing "hot-dark" print stability especially under harsh environmental conditions such as high temperature.

20 Claims, No Drawings

PHOTOTHERMOGRAPHIC MATERIALS CONTAINING PRINT STABILIZERS

FIELD OF THE INVENTION

This invention relates to photothermographic materials having sulfonyldiphenols that act as print stabilizers under harsh environmental conditions and also improve the Raw Stock Keeping of these materials. This invention also relates to methods of imaging and using these materials.

BACKGROUND OF THE INVENTION

Silver-containing direct thermographic and photothermographic imaging materials (that is, thermally developable imaging materials) that are imaged and/or developed using heat and without liquid processing have been known in the art for many years.

Silver-containing direct thermographic imaging materials are non-photosensitive materials that are used in a recording process wherein images are generated by the direct application of thermal energy and in the absence of a processing solvent. These materials generally comprise a support having disposed thereon (a) a relatively or completely non-photosensitive source of reducible silver ions, (b) a reducing composition (acting as a black-and-white silver developer) for the reducible silver ions, and (c) a suitable binder. Thermographic materials are sometimes called "direct thermal" materials in the art because they are directly imaged by a source of thermal energy without any transfer of the image or image-forming materials to another element (such as in thermal dye transfer).

In a typical thermographic construction, the image-forming thermographic layers comprise non-photosensitive reducible silver salts of long chain fatty acids. A preferred non-photosensitive reducible silver source is a silver salt of a long chain aliphatic carboxylic acid having from 10 to 30 carbon atoms, such as behenic acid or mixtures of acids of similar molecular weight. At elevated temperatures, the silver of the silver carboxylate is reduced by a reducing agent for silver ion (also known as a developer), whereby elemental silver is formed. Preferred reducing agents include methyl gallate, hydroquinone, substituted-hydroquinones, hindered phenols, catechols, pyrogallol, ascorbic acid, and ascorbic acid derivatives.

Some thermographic constructions are imaged by contacting them with the thermal head of a thermographic recording apparatus such as a thermal print-head of a thermal printer or thermal facsimile. In such constructions, an anti-stick layer is coated on top of the imaging layer to prevent sticking of the thermographic construction to the thermal head of the apparatus utilized. The resulting thermographic construction is then heated imagewise to an elevated temperature, typically in the range of from about 60 to about 225° C., resulting in the formation of a black-and-white image of silver.

Silver-containing photothermographic imaging materials (that is, photosensitive thermally developable imaging materials) that are imaged with actinic radiation and then developed using heat and without liquid processing, have also been known in the art for many years. Such materials are used in a recording process wherein an image is formed by imagewise exposure of the photothermographic material to specific electromagnetic radiation (for example, X-radiation, or ultraviolet, visible, or infrared radiation) and developed by the use of thermal energy. These materials, also known as "dry silver" materials, generally comprise a support having coated thereon: (a) a photocatalyst (that is, a photosensitive compound such as silver halide) that upon such exposure provides a latent image in exposed grains that are capable of acting as a catalyst for the subsequent formation of a silver image in a development step, (b) a relatively or completely non-photosensitive source of reducible silver ions, (c) a reducing composition (acting as a developer) for the reducible silver ions, and (d) a binder. The latent image is then developed by application of thermal energy.

In photothermographic materials, exposure of the photosensitive silver halide to light produces small clusters containing silver atoms $(Ag^0)_n$. The imagewise distribution of these clusters, known in the art as a latent image, is generally not visible by ordinary means. Thus, the photosensitive material must be further developed to produce a visible image. This is accomplished by the reduction of silver ions that are in catalytic proximity to silver halide grains bearing the silver-containing clusters of the latent image. This produces a black-and-white image. The non-photosensitive silver source is catalytically reduced to form the visible black-and-white negative image of silver while much of the silver halide, generally, remains as silver halide and is not reduced.

In photothermographic materials, the reducing agent for the reducible silver ions, often referred to as a "developer", may be any compound that, in the presence of the latent image, can reduce silver ion to metallic silver and is preferably of relatively low activity until it is heated to a temperature sufficient to cause the reaction. A wide variety of classes of compounds have been disclosed in the literature that function as reducing agents for photothermographic materials. Upon heating, and at elevated temperatures, the reducible silver ions are reduced by the reducing agent. This reaction occurs preferentially in the regions surrounding the latent image and produces a negative image of metallic silver having a color that ranges from yellow to deep black depending upon the presence of toning agents and other components in the photothermographic imaging layer(s).

Differences Between Photothermography and Photography

The imaging arts have long recognized that the field of photo-thermography is clearly distinct from that of photography. Photothermographic materials differ significantly from conventional silver halide photographic materials that require processing with aqueous processing solutions.

In photothermographic imaging materials, a visible image is created in the absence of a processing solvent by heat as a result of the reaction of a reducing agent incorporated within the material. Heating at 50° C. or more is essential for this dry development. In contrast, conventional photographic imaging materials require processing in aqueous processing baths at more moderate temperatures (from 30° C. to 50° C.) to provide a visible image.

In photothermographic materials, only a small amount of silver halide is used to capture light and a non-photosensitive source of reducible silver ions (for example, a silver carboxylate or a silver benzotriazole) is used to generate the visible image using thermal development. Thus, the imaged photosensitive silver halide serves as a catalyst for the physical development process involving the non-photosensitive source of reducible silver ions and the incorporated reducing agent. In contrast, conventional wet-processed, black-and-white photographic materials use only one form of silver (that is, silver halide) that, upon chemical development, is itself at least partially converted into the silver image, or that upon physical development requires addition of an external silver source (or other reducible metal ions that form black images upon reduction to the corresponding metal). Thus, photothermographic materials require an amount of silver halide per unit area that is only a fraction of that used in conventional wet-processed photographic materials.

In photothermographic materials, all of the "chemistry" for imaging is incorporated within the material itself. For example, such materials include a reducing agent (that is, a developer for the reducible silver ions) while conventional photographic materials usually do not. The incorporation of the reducing agent into photothermographic materials can lead to increased formation of various types of "fog" or other undesirable sensitometric side effects. Therefore, much effort has gone into the preparation and manufacture of photothermographic materials to minimize these problems.

Moreover, in photothermographic materials, the unexposed silver halide generally remains intact after development and the material must be stabilized against further imaging and development. In contrast, silver halide is removed from conventional photographic materials after solution development to prevent further imaging (that is in the aqueous fixing step).

Because photothermographic materials require dry thermal processing, they present distinctly different problems and require different materials in manufacture and use, compared to conventional, wet-processed silver halide photographic materials. Additives that have one effect in conventional silver halide photographic materials may behave quite differently when incorporated in photothermographic materials where the underlying chemistry is significantly more complex. The incorporation of such additives as, for example, stabilizers, antifoggants, speed enhancers, supersensitizers, and spectral and chemical sensitizers in conventional photographic materials is not predictive of whether such additives will prove beneficial or detrimental in photothermographic materials. For example, it is not uncommon for a photographic antifoggant useful in conventional photographic materials to cause various types of fog when incorporated into photothermographic materials, or for supersensitizers that are effective in photographic materials to be inactive in photothermographic materials.

These and other distinctions between photothermographic and photographic materials are described in *Unconventional Imaging Processes*, E. Brinckman et al. (Eds.), The Focal Press, London and New York, 1978, pp. 74-75, in D. H. Klosterboer, *Imaging Processes and Materials*, (*Neblette's Eighth Edition*), J. Sturge, V. Walworth, and A. Shepp, Eds., Van Nostrand-Reinhold, New York, 1989, Chapter 9, pp. 279-291, in C. Zou et al., *J. Imaging Sci. Technol.* 1996, 40, pp. 94-103, and in M. R. V. Sahyun, *J. Imaging Sci. Technol.* 1998, 42, 23.

Problem to be Solved

One problem encountered with photothermographic materials is the stability of the resulting images under harsh environmental conditions such as high temperature and humidity. Various compounds have been used for print stability in photothermographic materials as described for example in U.S. Pat. Nos. 5,158,866 (Simpson et al.), 5,175,081 (Krepski et al.), 5,196,301 (Simpson et al.), 5,298,390 (Sakizadeh et al.), 5,200,420 (Kenney et al.), 5,369,000 (Sakizadeh et al.), 5,370,988 (Manganiello et al.), 6,171,767 (Kong et al.), 6,368,778 (Kong et al.), 6,582,892 (Ramsden et al.), 6,645,714 (Katoh et al.), and 7,014,989 (Simpson et al.). Also useful are the blocked aliphatic thiol compounds described in U.S. Patent Application Publication 2006/0141403 (Ramsden et al.).

Another problem encountered in this art is the possible instability of the photothermographic materials during storage prior to handling or use. The desired property is known as "Natural Age Keeping" (NAK) that is also known as "Raw Stock Keeping" (RSK). This property is a measure of the stability at ambient temperature and relative humidity during storage prior to imaging. Raw Stock Keeping can be a problem for photothermographic materials compared to conventional silver halide films because, as noted above, all of the components for imaging and development are incorporated into the films, in intimate proximity, prior to development. Thus, there are a greater number of potentially reactive components that can prematurely react during storage, which results in higher fog formation.

Sulfonyldiphenols have been used as color developers in color-imaging thermally developable materials as described, for example, in Japanese Kokai 2001-260541 (Hata et al.) and in EP Publications 618,082 (Kobayashi et al.) and U.S. Pat. No. 1,080,939 (Midorikawa et al.).

The noted print stability problem has limited the commercial success of various products in countries where environmental conditions are harsher and not readily controlled. Thus, there is a continuing need to improve the print stability of such materials under such conditions that are sometimes known as "hot-dark" conditions that include storage of imaged and processed photothermographic materials at high temperature in the absence of light.

There is also a need to improve Raw Stock Keeping in such photothermographic materials especially if the materials are stored prior to use in harsher environmental conditions such as high humidity or high temperature.

SUMMARY OF THE INVENTION

To address this need, this invention provides a black-and-white photothermographic material comprising a support having on at least one side thereof, one or more photothermographic imaging layers comprising in reactive association:

a. a photosensitive silver halide, b. a non-photosensitive source of reducible silver ions, c. a reducing agent for the reducible silver ions, and d. a polymeric binder, the material further comprising a sulfonyldiphenol in an amount of at least 0.01 mmol/$m^2$.

This invention further provides a method of forming a visible black-and-white image comprising:

(A) imagewise exposing the photothermographic material of this invention to electromagnetic radiation to form a latent image, (B) simultaneously or sequentially, heating the exposed photothermographic material to develop the latent image into a visible image.

We have found that by incorporating sulfonyldiphenols and particularly 4,4'-sulfonyldiphenols into black-and-white photothermographic materials we can improve the stability of the resulting black-and-white images after thermal development when they are stored under conditions of higher temperature under various humidity conditions. Thus, we discovered that these sulfonyldiphenols (described in more detail below), previously used as color developers in color thermographic imaging materials, are useful as "hot-dark print stabilizers" in the black-and-white images. In some instances, very small amounts of the stabilizers are needed to solve the noted problem. We also found that this stabilization can be obtained when using silver halides of various grain sizes without any adverse effect on sensitometric parameters.

We have also unexpectedly found that the incorporation of the sulfonyldiphenols into the photothermographic materials improves Raw Stock Keeping under harsher environmental conditions including high temperature or humidity.

DETAILED DESCRIPTION OF THE INVENTION

The black-and-white photothermographic materials of this invention can be used to provide black-and-white images using appropriate silver halide imaging chemistry and particularly silver halides, non-photosensitive organic silver salts, reducing agents, toners, binders, and other components known to a skilled artisan. The black-and-white images are obtained in this invention without the use or presence of one or more leuco dyes that may be reacted with one or more color developers to provide a "black" image. The sulfonyldiphenols described herein as print stabilizers are generally present in reactive association with the imaging chemistry in the photothermographic materials.

The photothermographic materials can be used in black-and-white photothermography and in electronically generated black-and-white hardcopy recording. They can be used in microfilm applications, in radiographic imaging (for example digital medical imaging), X-ray radiography, and in industrial radiography. Furthermore, the absorbance of these materials between 350 and 450 nm is desirably low (less than 0.5), to permit their use in the graphic arts area (for example, image-setting and phototype-setting), in the manufacture of printing plates, in contact printing, in duplicating ("duping"), and in proofing.

The photothermographic materials are particularly useful for imaging of human or animal subjects in response to, X-radiation, ultraviolet, visible, or infrared radiation for use in a medical diagnosis. Such applications include, but are not limited to, thoracic imaging, mammography, dental imaging, orthopedic imaging, general medical radiography, therapeutic radiography, veterinary radiography, and autoradiography. When used with X-radiation, the photothermographic materials may be used in combination with one or more phosphor intensifying screens, with phosphors incorporated within the photothermographic emulsion, or with combinations thereof. Such materials are also useful for dental radiography when they are directly imaged by X-radiation. The materials are also useful for non-medical uses of X-radiation such as X-ray lithography and industrial radiography.

The photothermographic materials can be made sensitive to radiation of any suitable wavelength. Thus, in some embodiments, the materials are sensitive at ultraviolet, visible, infrared, or near infrared wavelengths, of the electromagnetic spectrum. In preferred embodiments, the materials are sensitive to radiation greater than 600 nm (and preferably sensitive to infrared radiation from about 700 up to about 950 nm). Increased sensitivity to a particular region of the spectrum is imparted through the use of various spectral sensitizing dyes.

In the photothermographic materials, the components needed for imaging can be in one or more photothermographic imaging layers on one side ("frontside") of the support. The layer(s) that contain the photosensitive photocatalyst (such as a photosensitive silver halide) or non-photosensitive source of reducible silver ions, or both, are referred to herein as photothermographic emulsion layer(s). The photocatalyst and the non-photosensitive source of reducible silver ions are in catalytic proximity and preferably are in the same emulsion layer.

Where the photothermographic materials contain imaging layers on one side of the support only, various non-imaging layers are usually disposed on the "backside" (non-emulsion or non-imaging side) of the materials, including conductive/antistatic layers, antihalation layers, protective layers, and transport enabling layers.

Various non-imaging layers can also be disposed on the "frontside" or imaging or emulsion side of the support, including protective frontside overcoat layers, primer layers, interlayers, opacifying layers, conductive/antistatic layers, antihalation layers, acutance layers, auxiliary layers, and other layers readily apparent to one skilled in the art.

For some embodiments, it may be useful that the photothermographic materials be "double-sided" or "duplitized" and have the same or different photothermographic coatings (or imaging layers) on both sides of the support. In such constructions each side can also include one or more protective overcoat layers, primer layers, interlayers, acutance layers, conductive/antistatic layers auxiliary layers, anti-crossover layers, and other layers readily apparent to one skilled in the art, as well as the required conductive layer(s).

When the photothermographic materials are heat-developed as described below in a substantially water-free condition after, or simultaneously with, imagewise exposure, a silver image (preferably a black-and-white silver image) is obtained.

DEFINITIONS

As used herein:

In the descriptions of the photothermographic materials, "a" or "an" component refers to "at least one" of that component (for example, the sulfonyldiphenols described herein).

As used herein, "black-and-white" preferably refers to an image formed by silver metal.

Unless otherwise indicated, the term "photothermographic materials" refers to materials of the present invention.

Heating in a substantially water-free condition as used herein, means heating at a temperature of from about 50° C. to about 250° C. with little more than ambient water vapor present. The term "substantially water-free condition" means that the reaction system is approximately in equilibrium with water in the air and water or any other solvent for inducing or promoting the reaction is not particularly or positively supplied from the exterior to the material. Such a condition is described in T. H. James, *The Theory of the Photographic Process*, Fourth Edition, Eastman Kodak Company, Rochester, N.Y., 1977, p. 374.

"Photothermographic material(s)" means a dry processable integral element comprising a support and at least one photothermographic emulsion layer or a photothermographic set of emulsion layers (wherein the photosensitive silver halide and the source of reducible silver ions are in one layer and the other necessary components or additives are distributed, as desired, in the same layer or in an adjacent coated layer). These materials also include multilayer constructions in which one or more imaging components (and the sulfonyldiphenols) are in different layers, but are in "reactive association". For example, one layer can include the non-photosensitive source of reducible silver ions and another layer can include the reducing composition, but the two reactive components are in reactive association with each other. By "integral", we mean that all imaging chemistry required for imaging is in the material without diffusion of imaging chemistry or reaction products (such as a dye) from or to another element (such as a receiver element).

When used in photothermography, the term, "imagewise exposing" or "imagewise exposure" means that the material is imaged as a dry processable material using any exposure means that provides a latent image using electro-magnetic radiation. This includes, for example, by analog exposure where an image is formed by projection onto the photosensitive material as well as by digital exposure where the image is formed one pixel at a time such as by modulation of scanning laser radiation.

The term "emulsion layer", "imaging layer", or "photothermographic emulsion layer" means a layer of a photothermographic material that contains the photosensitive silver halide and/or non-photosensitive source of reducible silver ions, or a reducing composition. Such layers can also contain additional components or desirable additives. These layers are usually on what is referred to as the "frontside" of the support.

"Photocatalyst" means a photosensitive compound such as silver halide that, upon exposure to radiation, provides a compound that is capable of acting as a catalyst for the subsequent development of the image-forming material.

"Catalytic proximity" or "reactive association" means that the reactive components are in the same layer or in adjacent layers so that they readily come into contact with each other during imaging and thermal development.

"Simultaneous coating" or "wet-on-wet" coating means that when multiple layers are coated, subsequent layers are coated onto the initially coated layer before the initially coated layer is dry. Simultaneous coating can be used to apply layers on the frontside, backside, or both sides of the support.

"Transparent" means capable of transmitting visible light or imaging radiation without appreciable scattering or absorption.

The phrases "silver salt" and "organic silver salt" refer to an organic molecule having a bond to a silver atom. Although the compounds so formed are technically silver coordination complexes or silver compounds they are also often referred to as silver salts.

The phrase "aryl group" refers to an organic group derived from an aromatic hydrocarbon by removal of one atom, such as a phenyl group formed by removal of one hydrogen atom from benzene.

The terms "coating weight", "coat weight", and "coverage" are synonymous, and are usually expressed in weight or moles per unit area such as $g/m^2$ or $mol/m^2$.

"Ultraviolet region of the spectrum" refers to that region of the spectrum less than or equal to 400 nm (preferably from about 100 nm to about 400 nm) although parts of these ranges may be visible to the naked human eye.

"Visible region of the spectrum" refers to that region of the spectrum of from about 400 nm to about 700 nm.

"Short wavelength visible region of the spectrum" refers to that region of the spectrum of from about 400 nm to about 450 nm.

"Red region of the spectrum" refers to that region of the spectrum of from about 600 nm to about 700 nm.

"Infrared region of the spectrum" refers to that region of the spectrum of from about 700 nm to about 1400 nm.

"Non-photosensitive" means not intentionally light sensitive.

The sensitometric terms "photospeed", "speed", or "photographic speed" (also known as sensitivity), absorbance, and contrast have conventional definitions known in the imaging arts. The sensitometric term absorbance is another term for optical density (OD).

The term "hot-dark print stability" refers to the susceptibility of imaged and processed photothermographic materials to undergo changes in such properties as Dmin, Dmax, tint, and tone during storage under hot conditions in the absence of light.

Image Tone refers to a measure of the extent of yellowness of the silver image. It is the difference in the optical density measured using a blue filter, from that of the optical density measured using a visible filter, at a visible density of 2.0. Larger Image Tone values indicate a bluer image. For use in medical imaging applications, a bluer image is generally preferred.

Speed-2 is Log1/E+4 corresponding to the density value of 1.0 above Dmin where E is the exposure in $ergs/cm^2$.

Average Contrast-1 ("AC-1") is the absolute value of the slope of the line joining the density points at 0.60 and 2.00 above Dmin.

The term Dmin (lower case) is considered herein as image density achieved when the photothermographic material is thermally developed without prior exposure to radiation. The term Dmax (lower case) is the maximum image density achieved in the imaged area of a particular sample after imaging and development.

The term DMIN (upper case) is the density of the non-imaged, undeveloped material. The term DMAX (upper case) is the maximum image density achievable when the photothermographic material is exposed and then thermally developed. DMAX is also known as "Saturation Density".

As is well understood in this art, for the chemical compounds herein described, substitution is not only tolerated, but is often advisable and various substitutents are anticipated on the compounds used in the present invention unless otherwise stated. Thus, when a compound is referred to as "having the structure" of a given formula or being a "derivative" of a compound, any substitution that does not alter the bond structure of the formula or the shown atoms within that structure is included within the formula, unless such substitution is specifically excluded by language.

As a means of simplifying the discussion and recitation of certain substitutent groups, the term "group" refers to chemical species that may be substituted as well as those that are not so substituted. Thus, the term "alkyl group" is intended to include not only pure hydrocarbon alkyl chains, such as methyl, ethyl, n-propyl, t-butyl, cyclohexyl, iso-octyl, and octadecyl, but also alkyl chains bearing substitutents known in the art, such as hydroxyl, alkoxy, phenyl, halogen atoms (F, Cl, Br, and I), cyano, nitro, amino, and carboxy. For example, alkyl group includes ether and thioether groups (for example $CH_3—CH_2—CH_2—O—CH_2—$ and $CH_3—CH_2—CH_2—S—CH_2—$), haloalkyl, nitroalkyl, alkylcarboxy, carboxyalkyl, carboxamido, hydroxyalkyl, sulfoalkyl, and other groups readily apparent to one skilled in the art. Substituents that adversely react with other active ingredients, such as very strongly electrophilic or oxidizing substitutents, would, of course, be excluded by the skilled artisan as not being inert or harmless.

*Research Disclosure* (http://www.researchdisclosure.com) is a publication of Kenneth Mason Publications Ltd., The Book Barn, Westbourne, Hampshire $PO_{10\ 8}RS$, UK. It is also available from Emsworth Design Inc., 200 Park Avenue South, Room 1101, New York, N.Y. 10003.

Other aspects, advantages, and benefits of the present invention are apparent from the detailed description, examples, and claims provided in this application.

The Photocatalyst

As noted above, photothermographic materials include one or more photocatalysts in the photothermographic emulsion layer(s). Useful photo catalysts are typically photosensitive silver halides such as silver bromide, silver iodide, silver chloride, silver bromoiodide, silver chlorobromoiodide, silver chlorobromide, and others readily apparent to one skilled in the art. Mixtures of silver halides can also be used in any suitable proportion. Silver bromide and silver iodide are preferred. More preferred is silver bromoiodide in which any suitable amount of iodide is present up to almost 100% silver iodide and more likely up to about 40 mol % silver iodide. Even more preferably, the silver bromoiodide comprises at least 70 mole % (preferably at least 85 mole % and more preferably at least 90 mole %) bromide (based on total silver halide). The remainder of the halide is iodide, chloride, or chloride and iodide. Preferably the additional halide is iodide. Silver bromide and silver bromoiodide are most preferred, with the latter silver halide generally having up to and including 10 mole % silver iodide.

In some embodiments of photothermographic materials, higher amounts of iodide may be present in homogeneous photosensitive silver halide grains, and particularly from about 20 mol % up to the saturation limit of iodide as described, for example, U.S. Patent Application Publication 2004/0053173 (Maskasky et al.).

The silver halide grains may have any crystalline habit or morphology including, but not limited to, cubic, octahedral, tetrahedral, orthorhombic, rhombic, dodecahedral, other polyhedral, tabular, laminar, twinned, or platelet morphologies and may have epitaxial growth of crystals thereon. If desired, a mixture of grains with different morphologies can be employed. Silver halide grains having cubic and tabular morphology (or both) are preferred.

The silver halide grains may have a uniform ratio of halide throughout. They may also have a graded halide content, with a continuously varying ratio of, for example, silver bromide and silver iodide or they may be of the core-shell type, having a discrete core of one or more silver halides, and a discrete shell of one or more different silver halides. Core-shell silver halide grains useful in photothermographic materials and methods of preparing these materials are described in U.S. Pat. No. 5,382,504 (Shor et al.). Iridium and/or copper doped core-shell and non-core-shell grains are described in U.S. Pat. Nos. 5,434,043 (Zou et al.) and 5,939,249 (Zou). Bismuth(III)—doped high silver iodide emulsions for aqueous-based photothermographic materials are described in U.S. Pat. No. 6,942,960 (Maskasky et al.).

In some instances, it may be helpful to prepare the photosensitive silver halide grains in the presence of a hydroxytetraazaindene (such as 4-hydroxy-6-methyl-1,3,3a,7-tetraazaindene) or an N-heterocyclic compound comprising at least one mercapto group (such as 1-phenyl-5-mercaptotetrazole) as described in U.S. Pat. No. 6,413,710 (Shor et al.).

The photosensitive silver halide can be added to (or formed within) the emulsion layer(s) in any fashion as long as it is placed in catalytic proximity to the non-photosensitive source of reducible silver ions.

It is preferred that the silver halides be preformed and prepared by an ex-situ process. With this technique, one has the possibility of more precisely controlling the grain size, grain size distribution, dopant levels, and composition of the silver halide, so that one can impart more specific properties to both the silver halide grains and the resulting photothermographic material.

In some constructions, it is preferable to form the non-photo sensitive source of reducible silver ions in the presence of ex-situ-prepared silver halide. In this process, the source of reducible silver ions, such as a long chain fatty acid silver carboxylate (commonly referred to as a silver "soap" or homogenate), is formed in the presence of the preformed silver halide grains. Co-precipitation of the source of reducible silver ions in the presence of silver halide provides a more intimate mixture of the two materials to provide a material often referred to as a "preformed soap" [see U.S. Pat. No. 3,839,049 (Simons)].

In some constructions, it is preferred that preformed silver halide grains be added to and "physically mixed" with the non-photosensitive source of reducible silver ions.

Preformed silver halide emulsions can be prepared by aqueous or organic processes and can be unwashed or washed to remove soluble salts. Soluble salts can be removed by any desired procedure for example as described in U.S. Pat. Nos. 2,489,341 (Waller et al.), 2,565,418 (Yackel), 2,614,928 (Yutzy et al.), 2,618,556 (Hewitson et al.), and 3,241,969 (Hart et al.).

It is also effective to use an in-situ process in which a halide- or a halogen-containing compound is added to an organic silver salt to partially convert the silver of the organic silver salt to silver halide. Inorganic halides (such as zinc bromide, zinc iodide, calcium bromide, lithium bromide, lithium iodide, or mixtures thereof) or an organic halogen-containing compound (such as N-bromo-succinimide or pyridinium hydrobromide perbromide) can be used. The details of such in-situ generation of silver halide are well known and described in U.S. Pat. No. 3,457,075 (Morgan et al.).

It is particularly effective to use a mixture of both preformed and in-situ generated silver halide. The preformed silver halide is preferably present in a preformed soap.

Additional methods of preparing silver halides and organic silver salts and blending them are described in *Research Disclosure*, June 1978, item 17029, U.S. Pat. Nos. 3,700,458 (Lindholm) and 4,076,539 (Ikenoue et al.), and Japan Kokai 49-013224 (Fuji), 50-017216 (Fuji), and 51-042529 (Fuji).

The silver halide grains used in the imaging formulations can vary in average diameter of up to several micrometers (μm) depending on the desired use. Preferred silver halide grains for use in preformed emulsions containing silver carboxylates are cubic grains having a number average particle size of from about 0.01 to about 1.0 μm, more preferred are those having a number average particle size of from about 0.03 to about 0.1 μm. It is even more preferred that the grains have a number average particle size of 0.06 μm or less, and most preferred that they have a number average particle size of from about 0.02 to about 0.06 μm (that is from about 20 to about 60 nm). Mixtures of grains of various average particle sizes can also be used. Preferred silver halide grains for high-speed photothermographic constructions use are tabular grains having an average thickness of at least 0.02 μm and up to and including 0.10 μm, an equivalent circular diameter of at least 0.5 μm and up to and including 8 μm and an aspect ratio of at least 5:1. More preferred are those having an average thickness of at least 0.03 μm and up to and including 0.08 μm, an equivalent circular diameter of at least 0.75 μm and up to and including 6 μm and an aspect ratio of at least 10:1.

The average size of the photosensitive silver halide grains is expressed by the average diameter if the grains are spherical, and by the average of the diameters of equivalent circles for the projected images if the grains are cubic or in other non-spherical shapes. Representative grain sizing methods are described in *Particle Size Analysis*, ASTM Symposium on Light Microscopy, R. P. Loveland, 1955, pp. 94-122, and in C. E. K. Mees and T. H. James, *The Theory of the Photographic Process*, Third Edition, Macmillan, New York, 1966, Chapter 2. Particle size measurements may be expressed in terms of the projected areas of grains or approximations of their diameters. These will provide reasonably accurate results if the grains of interest are substantially uniform in shape.

The one or more light-sensitive silver halides are preferably present in an amount of from about 0.005 to about 0.5 mole, more preferably from about 0.01 to about 0.25 mole, and most preferably from about 0.03 to about 0.15 mole, per mole of non-photosensitive source of reducible silver ions.

Chemical Sensitization

The photosensitive silver halides can be chemically sensitized using any useful compound that contains sulfur, tellurium, or selenium, or may comprise a compound containing gold, platinum, palladium, ruthenium, rhodium, iridium, or combinations thereof, a reducing agent such as a tin halide or a combination of any of these. The details of these materials are provided for example, in T. H. James, *The Theory of the Photographic Process*, Fourth Edition, Eastman Kodak Company, Rochester, N.Y., 1977, Chapter 5, pp. 149-169. Suitable conventional chemical sensitization procedures are also described in U.S. Pat. Nos. 1,623,499 (Sheppard et al.), 2,399,083 (Waller et al.), 3,297,446 (Dunn), 3,297,447 (McVeigh), 5,049,485 (Deaton), 5,252,455 (Deaton), 5,391,727 (Deaton), 5,759,761 (Lushington et al.), and 5,912,111 (Lok et al.), and EP 0 915 371A1 (Lok et al.).

Mercaptotetrazoles and tetraazindenes as described in U.S. Pat. No. 5,691,127 (Daubendiek et al.) can also be used as suitable addenda for tabular silver halide grains.

Certain substituted and unsubstituted thiourea compounds can be used as chemical sensitizers including those described in U.S. Pat. No. 6,368,779 (Lynch et al.).

Still other additional chemical sensitizers include certain tellurium-containing compounds that are described in U.S. Pat. No. 6,699,647 (Lynch et al.), and certain selenium-containing compounds that are described in U.S. Pat. No. 6,620,577 (Lynch et al.).

Combinations of gold(III)-containing compounds and either sulfur-, tellurium-, or selenium-containing compounds are also useful as chemical sensitizers as described in U.S. Pat. No. 6,423,481 (Simpson et al.).

In addition, sulfur-containing compounds can be decomposed on silver halide grains in an oxidizing environment according to the teaching in U.S. Pat. No. 5,891,615 (Winslow et al.). Examples of sulfur-containing compounds that can be used in this fashion include sulfur-containing spectral sensitizing dyes. Other useful sulfur-containing chemical sensitizing compounds that can be decomposed in an oxidizing environment are the diphenylphosphine sulfide compounds described in U.S. Pat. Nos. 7,026,105 (Simpson et al.) and 7,063,941 (Burleva et al.), and in U.S. Patent Application Publication 2005/0123871 (Burleva et al.).

The chemical sensitizers can be present in conventional amounts that generally depend upon the average size of the silver halide grains. Generally, the total amount is at least $10^{-10}$ mole per mole of total silver, and preferably from about $10^{-8}$ to about $10^{-2}$ mole per mole of total silver for silver halide grains having an average size of from about 0.01 to about 1 μm.

Spectral Sensitization

The photosensitive silver halides may be spectrally sensitized with one or more spectral sensitizing dyes that are known to enhance silver halide sensitivity to ultraviolet, visible, and/or infrared radiation (that is, sensitivity within the range of from about 300 to about 1400 nm). It is preferred that the photosensitive silver halide be sensitized to infrared radiation (that is from about 700 to about 950 nm). Non-limiting examples of spectral sensitizing dyes that can be employed include cyanine dyes, merocyanine dyes, complex cyanine dyes, complex merocyanine dyes, holopolar cyanine dyes, hemicyanine dyes, styryl dyes, and hemioxanol dyes. They may be added at any stage in the preparation of the photothermographic emulsion, but are generally added after chemical sensitization is achieved.

Suitable spectral sensitizing dyes such as those described in U.S. Pat. Nos. 3,719,495 (Lea), 4,396,712 (Kinoshita et al.), 4,439,520 (Kofron et al.), 4,690,883 (Kubodera et al.), 4,840,882 (Iwagaki et al.), 5,064,753 (Kohno et al.), 5,281,515 (Delprato et al.), 5,393,654 (Burrows et al.), 5,441,866 (Miller et al.), 5,508,162 (Dankosh), 5,510,236 (Dankosh), and 5,541,054 (Miller et al.), Japan Kokai 2000-063690 (Tanaka et al.), 2000-112054 (Fukusaka et al.), 2000-273329 (Tanaka et al.), 2001-005145 (Arai), 2001-064527 (Oshiyama et al.), and 2001-154305 (Kita et al.) can be used. Useful spectral sensitizing dyes are also described in *Research Disclosure*, December 1989, item 308119, Section IV and *Research Disclosure,* 1994, item 36544, section V.

Teachings relating to specific combinations of spectral sensitizing dyes also include U.S. Pat. Nos. 4,581,329 (Sugimoto et al.), 4,582,786 (Ikeda et al.), 4,609,621 (Sugimoto et al.), 4,675,279 (Shuto et al.), 4,678,741 (Yamada et al.), 4,720,451 (Shuto et al.), 4,818,675 (Miyasaka et al.), 4,945,036 (Arai et al.), and 4,952,491 (Nishikawa et al.).

Also useful are spectral sensitizing dyes that decolorize by the action of light or heat as described in U.S. Pat. No. 4,524,128 (Edwards et al.) and Japan Kokai 2001-109101 (Adachi), 2001-154305 (Kita et al.), and 2001-183770 (Hanyu et al.).

Dyes and other compounds may be selected for the purpose of supersensitization to attain much higher sensitivity than the sum of sensitivities that can be achieved by using a sensitizer alone. Examples of such supersensitizers include the metal chelating compounds disclosed in U.S. Pat. No. 4,873,184 (Simpson), the large cyclic compounds featuring a heteroatom disclosed in U.S. Pat. No. 6,475,710 (Kudo et al.), the stilbene compounds disclosed in EP 0 821 271 (Uytterhoeven et al.).

An appropriate amount of spectral sensitizing dye added is generally about $10^{-10}$ to $10^{-1}$ mole, and preferably, about $10^{-7}$ to $10^{-2}$ mole per mole of silver halide.

Non-Photosensitive Source of Reducible Silver Ions

The non-photosensitive source of reducible silver ions in the photothermographic materials is a silver-organic compound that contains reducible silver(I) ions. Such compounds are generally silver salts of silver organic coordinating ligands that are comparatively stable to light and form a silver image when heated to 50° C. or higher in the presence of an exposed photocatalyst (such as silver halide) and a reducing agent composition.

The primary organic silver salt is often a silver salt of an aliphatic carboxylic acid (described below). Mixtures of silver salts of aliphatic carboxylic acids are particularly useful where the mixture includes at least silver behenate.

Useful silver carboxylates include silver salts of long-chain aliphatic carboxylic acids. The aliphatic carboxylic acids generally have aliphatic chains that contain 10 to 30, and preferably 15 to 28, carbon atoms. Examples of such preferred silver salts include silver behenate, silver arachidate, silver stearate, silver oleate, silver laurate, silver caprate, silver myristate, silver palmitate, silver maleate, silver fumarate, silver tartarate, silver furoate, silver linoleate, silver butyrate, silver camphorate, and mixtures thereof. Most preferably, at least silver behenate is used alone or in mixtures with other silver carboxylates.

Silver salts other than the silver carboxylates described above can be used also. Such silver salts include silver salts of aliphatic carboxylic acids containing a thioether group as described in U.S. Pat. No. 3,330,663 (Weyde et al.), soluble silver carboxylates comprising hydrocarbon chains incorporating ether or thioether linkages or sterically hindered substitution in the α-(on a hydrocarbon group) or ortho- (on an phenyl group) position as described in U.S. Pat. No. 5,491,059 (Whitcomb), silver salts of dicarboxylic acids, silver salts of sulfonates as described in U.S. Pat. No. 4,504,575 (Lee), silver salts of sulfosuccinates as described in EP 0 227 141A1 (Leenders et al.), silver salts of aryl carboxylic acids (such as silver benzoate), silver salts of acetylenes as described, for example in U.S. Pat. Nos. 4,761,361 (Ozaki et al.) and 4,775,613 (Hirai et al.), and silver salts of heterocyclic compounds containing mercapto or thione groups and derivatives as described in U.S. Pat. Nos. 4,123,274 (Knight et al.) and 3,785,830 (Sullivan et al.).

It is also convenient to use silver half soaps such as an equimolar blend of silver carboxylate and carboxylic acid that analyzes for about 14.5% by weight solids of silver in the blend and that is prepared by precipitation from an aqueous solution of an ammonium or an alkali metal salt of a commercially available fatty carboxylic acid, or by addition of the free fatty acid to the silver soap.

The methods used for making silver soap emulsions are well known in the art and are disclosed in *Research Disclosure*, April 1983, item 22812, *Research Disclosure*, October 1983, item 23419, U.S. Pat. No. 3,985,565 (Gabrielsen et al.) and the references cited above.

Sources of non-photosensitive reducible silver ions can also be core-shell silver salts as described in U.S. Pat. No. 6,355,408 (Whitcomb et al.), wherein a core has one or more silver salts and a shell has one or more different silver salts, as long as one of the silver salts is a silver carboxylate. Other useful sources of non-photosensitive reducible silver ions are the silver dimer compounds that comprise two different silver salts as described in U.S. Pat. No. 6,472,131 (Whitcomb). Still other useful sources of non-photosensitive reducible silver ions are the silver core-shell compounds comprising a primary core comprising one or more photosensitive silver halides, or one or more non-photo sensitive inorganic metal salts or non-silver containing organic salts, and a shell at least partially covering the primary core, wherein the shell comprises one or more non-photosensitive silver salts, each of which silver salts comprises a organic silver coordinating ligand. Such compounds are described in U.S. Pat. No. 6,803,177 (Bokhonov et al.).

Organic silver salts that are particularly useful in organic solvent-based photothermographic materials include silver carboxylates (both aliphatic and aryl carboxylates), silver benzotriazolates, silver sulfonates, silver sulfo-succinates, and silver acetylides. Silver salts of long-chain aliphatic carboxylic acids containing 15 to 28 carbon atoms and silver salts of benzotriazoles are particularly preferred. Silver carboxylates containing silver behenate are most preferred.

Organic silver salts that are particularly useful in aqueous based photothermographic materials include silver salts of compounds containing an imino group. Preferred examples of these compounds include, but are not limited to, silver salts of benzotriazole and substituted derivatives thereof (for example, silver methylbenzotriazole and silver 5-chlorobenzotriazole), silver salts of 1,2,4-triazoles or 1-H-tetrazoles such as phenylmercaptotetrazole as described in U.S. Pat. No. 4,220,709 (deMauriac), and silver salts of imidazoles and imidazole derivatives as described in U.S. Pat. No. 4,260,677 (Winslow et al.). Particularly useful silver salts of this type are the silver salts of benzotriazole and substituted derivatives thereof. A silver salt of a benzotriazole is particularly preferred in aqueous-based photothermographic formulations.

Useful nitrogen-containing organic silver salts and methods of preparing them are described in U.S. Pat. No. 6,977,139 (Hasberg et al.). Such silver salts (particularly the silver benzotriazoles) are rod-like in shape and have an average aspect ratio of at least 3:1 and a width index for particle diameter of 1.25 or less. Silver salt particle length is generally less than 1 μm. Silver salt-toner co-precipitated nano-crystals comprising a silver salt of a nitrogen-containing heterocyclic compound containing an imino group, and a silver salt comprising a silver salt of a mercaptotriazole, are also useful. Such co-precipitated salts are described in U.S. Pat. No. 7,008,748 (Hasberg et al.).

The one or more non-photosensitive sources of reducible silver ions are preferably present in an amount of from about 5% to about 70%, and more preferably from about 10% to about 50%, based on the total dry weight of the emulsion layers. Alternatively stated, the amount of the sources of reducible silver ions is generally from about 0.002 to about 0.2 mol/m$^2$ of the dry photo thermographic material (preferably from about 0.01 to about 0.05 mol/m$^2$).

The total amount of silver (from all silver sources) in the photo thermographic materials is generally at least 0.002 mol/m$^2$, preferably from about 0.01 to about 0.05 mol/m$^2$, and more preferably from about 0.01 to about 0.02 mol/m$^2$. In other aspects, it is desirable to use total silver [from both silver halide (when present) and reducible silver salts] at a coating weight of less than 2.6 g/m$^2$, preferably at least 1 but less than and including 1.9 g/m$^2$.

Reducing Agent

The reducing agent (or reducing agent composition comprising one or more reducing agents) for the source of reducible silver ions is a compound (preferably an organic compound) that can reduce silver(I) ion to metallic silver. The "reducing agent" is sometimes called a "developer" or "developing agent".

"Ascorbic acids" are useful reducing agents. Such compounds include ascorbic acid, complexes, and derivatives thereof. Ascorbic acid reducing agents are described in a considerable number of publications including U.S. Pat. No. 5,236,816 (Purol et al.) and references cited therein. Useful ascorbic acid developing agents include ascorbic acid and the analogues, isomers and derivatives thereof. Such compounds include, but are not limited to, D- or L-ascorbic acid, sugar-type derivatives thereof (such as sorboascorbic acid, γ-lacto-ascorbic acid, 6-desoxy-L-ascorbic acid, L-rhamnoascorbic acid, imino-6-desoxy-L-ascorbic acid, glucoascorbic acid, fucoascorbic acid, glucoheptoascorbic acid, maltoascorbic acid, L-arabosascorbic acid), sodium ascorbate, potassium ascorbate, isoascorbic acid (or L-erythroascorbic acid), and salts thereof (such as alkali metal, ammonium, or others known in the art), endiol type ascorbic acid, an enaminol type ascorbic acid, a thioenol type ascorbic acid, and an enamin-thiol type ascorbic acid, as described in EP 0 573 700A1 (Lingier et al.), EP 0 585 792A1 (Passarella et al.), EP 0 588 408A1 (Hieronymus et al.), U.S. Pat. Nos. 2,688,549 (James et al.), 5,089,819 (Knapp), 5,278,035 (Knapp), 5,376,510 (Parker et al.), 5,384,232 (Bishop et al.), and 5,498,511 (Yamashita et al.), Japanese Kokai 7-56286 (Toyoda), and *Research Disclosure*, item 37152, March 1995. Mixtures of these developing agents can be used if desired.

Additionally useful are the ascorbic acid reducing agents described in U.S. Patent Application Publication 2005/0164136 (Ramsden et al.). Also useful are the solid particle dispersions of certain ascorbic acid esters that are prepared in the presence of a particle growth modifier that are described in U.S. Patent Application Publication 2006/0051714 (Brick et al.).

When a silver carboxylate silver source is used in a photothermo graphic material, one or more hindered phenol or hindered bisphenol reducing agents are preferred. In some instances, the reducing agent composition comprises two or more components such as a hindered phenol or hindered bisphenol developer and one or more co-reducing agents (also known as co-developers) that can be chosen from the various classes of co-developers described below. Ternary developer mixtures involving the further addition of contrast enhancing agents are also useful. Such contrast enhancing agents can be chosen from the various classes of reducing agents described below.

"Hindered phenol reducing agents" are compounds that contain only one hydroxy group on a given phenyl ring and have at least one additional substitutent located ortho to the hydroxy group.

One type of hindered phenol reducing agents includes hindered phenols and hindered naphthols. This type of hindered phenol includes, for example, 2,6-di-t-butyl-4-methylphenol, 2,6-di-t-butyl-4-benzylphenol 2-benzyl-4-methyl-6-t-butylphenol, 2,4-dimethyl-6-(1'-methylcyclohexyl)phenol, and 3,5-bis(1,1-dimethylethyl)-4-hydroxybenzenepropanoic acid 2,2-bis[[3-[3,5-bis(1,1-dimethylethyl)-4-hydroxyphenyl]-1-oxopropoxy]methyl]-1,3-propanediyl ester (IRGANOX® 1010).

Another type of hindered phenol reducing agent are hindered bisphenols. "Hindered bisphenols" contain more than one hydroxy group each of which is located on a different phenyl ring. This type of hindered phenol includes, for example, bisnaphthols (that is dihydroxybinaphthyls), bisphenols (that is dihydroxybiphenyls), bis(hydroxynaphthyl)methanes, bis(hydroxyphenyl)-methanes, bis(hydroxyphenyl)ethers, bis(hydroxyphenyl)sulfones, and bis(hydroxyphenyl)thioethers, each of which may have additional substitutents.

Preferred hindered bisphenol reducing agents are bis(hydroxy-phenyl)methanes such as, bis(2-hydroxy-3-t-butyl-5-methylphenyl)methane, 1,1'-bis(2-hydroxy-3,5-dimethylphenyl)-3,5,5-trimethylhexane, bis[2-hydroxy-3-(1-methylcyclohexyl)-5-methylphenyl)methane, 1,1'-bis(2-hydroxy-3,5-dimethylphenyl)isobutane, and 2,6-bis[(2-hydroxy-3,5-dimethylphenyl)-methyl]-4-methylphenol. Such hindered bisphenol compounds have at least one substitutent ortho to the hydroxyl group and are often referred to as "hindered ortho-bisphenols.

Further examples of ortho-substituted bisphenol reducing agents include bisphenols having non-aromatic cyclic groups attached to the linking methylene group as described for example, in U.S. Pat. No. 6,699,649 (Nishijima et al.), bisphenols having cycloaliphatic or alkylene groups attached to the linking methylene group as described for example in U.S. Patent Application Publication 2005/0221237 (Sakai et al.), and bisphenols having secondary or tertiary substitutents on the phenol rings as described for example, in U.S. Pat. No. 6,485,898 (Yoshioka et al.). Also useful reducing agents are ortho-substituted bisphenol reducing agents, each incorporating bicyclic or tricyclic substitutents ortho to the one or both hydroxyl groups on the aromatic rings as described, for example, in copending and commonly assigned U.S. Ser. No. 11/351,953 (filed Feb. 10, 2006 by Lynch, Ramsden, Hansen, and Ulrich) that is incorporated herein by reference.

Additional reducing agents include the bisphenol-phosphorous compounds described in U.S. Pat. No. 6,514,684 (Suzuki et al), the bisphenol, aromatic carboxylic acid, hydrogen bonding compound mixture described in U.S. Pat. No. 6,787,298 (Yoshioka), and the compounds that can be one-electron oxidized to provide an one-electron oxidation product that releases one or more electrons as described in U.S. Patent Application Publication 2005/0214702 (Ohzeki). Other reducing agents that can be used include substituted hydrazines such as the sulfonyl hydrazides described in U.S. Pat. No. 5,464,738 (Lynch et al.). Still other useful reducing agents are described in U.S. Pat. Nos. 3,074,809 (Owen), 3,080,254 (Grant, Jr.), 3,094,417 (Workman), 3,887,417 (Klein et al.), 4,030,931 (Noguchi et al.), and 5,981,151 (Leenders et al.).

Mixtures of different classes of hindered phenol reducing agents can be used if desired, such as the mixture of a hindered mono-phenol and a hindered bisphenol described in U.S. Pat. No. 6,413,712 (Yoshioka et al.) and 6,645,714 (Oya et al.).

Additional useful reducing agents include the bisphenol-phosphorous compounds described in U.S. Pat. No. 6,514,684 (Suzuki et al), the bisphenol, aromatic carboxylic acid, hydrogen bonding compound mixture described in U.S. Pat. No. 6,787,298 (Yoshioka), and the compounds that can be one-electron oxidized to provide a one-electron oxidation product that releases one or more electrons as described in U.S. Patent Application Publication 2005/0214702 (Ohzeki). Other reducing agents that can be used include substituted hydrazines such as the sulfonyl hydrazides described in U.S. Pat. No. 5,464,738 (Lynch et al.). Still other useful reducing agents are described in U.S. Pat. Nos. 3,074,809 (Owen), 3,080,254 (Grant, Jr.), 3,094,417 (Workman), 3,887,417 (Klein et al.), 4,030,931 (Noguchi et al.), and 5,981,151 (Leenders et al.).

Additional reducing agents that may be used along with the reducing agent mixture described above, include amidoximes, azines, a combination of aliphatic carboxylic acid aryl hydrazides and ascorbic acid, a reductone and/or a hydrazine, piperidinohexose reductone or formyl-4-methylphenylhydrazine, hydroxamic acids, a combination of azines and sulfonamidophenols, α-cyanophenylacetic acid derivatives, reductones, indane-1,3-diones, chromans, 1,4-dihydropyridines, and 3-pyrazolidones.

Particularly useful reducing agent compositions include one or more phenolic compounds including monophenols, bisphenols, and trisphenols as described for example in U.S. Pat. Nos. 6,413,712 (Yoshioka et al.) and 6,645,714 (Oya et al.), such as combinations or mixtures of at least one hindered monophenol and at least one hindered bisphenol, at least one hindered monophenol and at least one hindered trisphenol, or at least one of each of the hindered monophenols, bisphenols, and trisphenols.

In some preferred embodiments, a combination of reducing agents can be used. Such a combination can comprise two or more reducing agents chosen from the following classes of compounds:

(a) a trisphenol represented by the following Structure (I), (b) a monophenol represented by the following Structure (II), or (c) a bisphenol represented by the following Structure (III):

Structure (I)

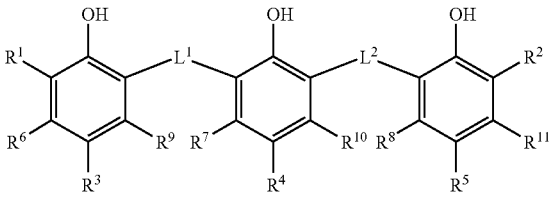

Structure (II)

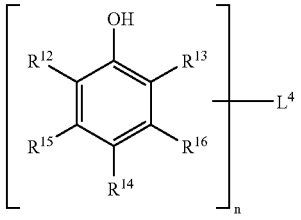

Structure (III)

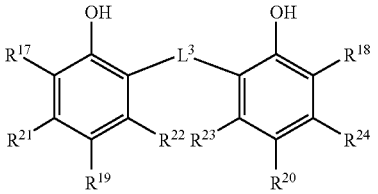

wherein $L^1$, $L^2$, and $L^3$ are independently sulfur or a mono-substituted or unsubstituted methylene group, $R^1$ and $R^2$ are independently primary or secondary substituted or unsubstituted alkyl groups having 1 to 12 carbon atoms that can be linear, branched or cyclic (such as methyl, ethyl, n-propyl, iso-propyl, iso-butyl, cyclohexyl, benzyl, 4-methylcyclohexyl, norbornyl, or isobornyl), $R^3$, $R^4$, $R^5$, $R^{19}$, and $R^{20}$ are independently substituted or unsubstituted alkyl groups having 1 to 12 carbon atoms (such as methyl, ethyl, n-propyl, iso-propyl, iso-butyl, tert-butyl, cyclohexyl, benzyl, 4-methyl-cyclohexyl, norbornyl, or isobornyl), substituted or unsubstituted alkoxy groups having 1 to 12 carbon atoms (such as methoxy, ethoxy, propoxy, iso-propoxy, or n-butoxy), or halo groups (such as chloro or bromo), $R^6$, $R^7$, $R^8$, $R^9$, $R^{10}$, $R^{11}$, $R^{21}$, $R^{22}$, $R^{23}$, and $R^{24}$ are independently hydrogen or any substitutent that is substitutable on a benzene ring, $R^{12}$ and $R^{13}$ are independently substituted or unsubstituted alkyl groups having 1 to 12 carbon atoms exclusive of 2-hydroxyphenylmethyl group, (such as methyl, ethyl, n-propyl, iso-propyl, iso-butyl, tert-butyl, 1-methylcyclohexyl, cyclohexyl, benzyl, tert-pentyl, norbornyl, or isobornyl), substituted or unsubstituted alkoxy groups having 1 to 12 carbon atoms (as defined above), halo groups (such as chloro or bromo), or hydrogen, such that both $R^{12}$ and $R^{13}$ are not both simultaneously hydrogen, $R^{14}$, $R^{15}$, and $R^{16}$ are independently hydrogen, or any substitutent that is substitutable on a benzene ring, $R^{17}$ and $R^{18}$ are independently substituted or unsubstituted alkyl groups having 1 to 12 carbon atoms (as defined above for $R^{12}$ and $R^{13}$), n is an integer of 1 or greater, and when n is 2 or greater, $L^4$ is a single bond or a linking group that is attached to any of $R^{12}$, $R^{13}$, $R^{14}$, $R^{15}$, or $R^{16}$.

One skilled in the art would understand that when n is 1, $L^4$ is not present.

The amount of the reducing agent(s) in the photothermographic materials is generally from about 0.5 to about 30% (dry weight of the layer), or from about 0.05 to about 0.5 mol/mol of total silver, and preferably is from about 1 to about 10% (dry weight) or from about 0.05 to about 0.25 mol/mol of total silver.

The reducing agent composition can also include high contrast enhancing agents. Such materials are useful for preparing printing plates and duplicating films useful in graphic arts, or for nucleation of medical diagnostic films. These "high contrast enhancing agents" are also identified in the art as "contrast enhancing agents", "nucleating agents", and "silver saving agents". Examples of such compounds are described in U.S. Pat. Nos. 6,150,084 (Ito et al.) and 6,620,582 (Hirabayashi). Certain contrast enhancing agents are preferably used in some photothermographic materials with specific reducing agents and the co-developers described herein. Examples of such useful high contrast enhancing agents include, but are not limited to, hydroxylamines, alkanolamines and ammonium phthalamate compounds as described in U.S. Pat. No. 5,545,505 (Simpson), hydroxamic acid compounds as described for example, in U.S. Pat. No. 5,545,507 (Simpson et al.), N-acylhydrazine compounds as described in U.S. Pat. No. 5,558,983 (Simpson et al.), and hydrogen atom donor compounds as described in U.S. Pat. No. 5,637,449 (Harring et al.). It would be understood by one skilled in the art that such compounds may have varying effectiveness depending upon the imaging chemistry in which they are used and the amount at which they are used, and that they also may have multiple properties, for example, acting as co-developers as well as enhancing contrast.

The high contrast enhancing agents can be present in an amount of from about 0.0005 to about 1 $g/m^2$ and preferably from about 0.001 to about 0.5 $g/m^2$.

In addition to the reducing agents described above, the photothermographic materials may also contain one or more co-developer compounds. "Co-developers" are organic compounds that by themselves do not act as effective reducing agents for the non-photosensitive silver salt, but when used in combination with a reducing agent and a non-photosensitive silver salt provide, upon development, increased silver development.

Thus, in some instances, the reducing agent composition comprises in addition to the reducing agent(s), one or more co-developers (also known as co-reducing agents). Such contrast enhancing agents can be chosen from the various classes of reducing agents described below.

Classes of co-developers that can be used in combination with the reducing agents described herein are trityl hydrazides and formyl phenyl hydrazides as described in U.S. Pat. No. 5,496,695 (Simpson et al.). Yet another class of co-developers includes substituted acrylonitrile compounds such as those described in U.S. Pat. Nos. 5,545,515 (Murray et al.) and 5,635,339 (Murray). Also useful are 2-substituted malondialdehyde compounds such as those described in U.S. Pat. No. 5,654,130 (Murray), 4-substituted isoxazoles such as those described in U.S. Pat. No. 5,705,324 (Murray), cyclic enols and enol ethers such as those described in U.S. Pat. No. 6,387,605 (Lynch et al.), and the crown ether-alkali metal complex cation of an enolate anion of an aldehyde having at least one electron withdrawing group in the alpha (α) position, as described in copending and commonly assigned U.S. Ser. No. 11/455,415 (filed Jun. 19, 2006 by Kumars Sakizadeh and Sharon M. Simpson) that is incorporated herein by reference.

One or more co-developer compounds can be added to any layer on the side of the support having a photothermographic emulsion layer as long as they are allowed to come into intimate contact with the emulsion layer during coating, drying, storage, thermal development, or post-processing storage. Thus one or more co-developer compounds can be added directly to the photothermo graphic emulsion layer or to one or more overcoat layers above the emulsion layer (for example a topcoat layer, interlayer, or barrier layer) and/or below the emulsion layer (such as to a primer layer, subbing layer, or carrier layer). Preferably one or more co-developer compounds are added directly to the emulsion layer or to an overcoat layer and allowed to diffuse into the emulsion layer.

Where the photothermographic material has one or more photo thermographic layers on both sides of the support, one or more of the same or different co-developer compounds can be used on one or both sides of the support.

Generally, one or more co-developer compounds are present in a total amount of at least 0.0005 g/m$^2$ in one or more layers on the imaging side of the support, of the emulsion layer into which they are incorporated or diffused. The co-developers are preferably present in a total amount of from about 0.0005 g/m$^2$ to about 0.15 g/m$^2$, and preferably present in a total amount of from about 0.001 to about 0.05 g/m$^2$ in one or more layers on an imaging side of the support. The molar ratio of reducing agent to co-developer is generally from about 5,000:1 to about 10:1, preferably from about 1000:1 to about 100:1.

Sulfonyldiphenol Compounds

The photothermographic materials include one or more sulfonyldiphenol compounds as described herein particularly as post-processing "hot-dark" stabilizers. These compounds are usually in the one or more photothermographic emulsion layers but they can be optionally or additionally located in adjacent layers such as underlayers, interlayers, carrier layers, and protective overcoats on the imaging side of the support. The sulfonyldiphenol compounds readily diffuse among and throughout such layers, and there are usually at least some of them in the emulsion layer(s).

The one or more sulfonyldiphenols are present in the materials in a total amount of at least 0.01 mmol/m$^2$, and preferably at from about 0.05 to about 6 mmol/m$^2$, and more preferably from about 0.05 to about 2 mmol/m.

While 2,2'-sulfonyldiphenols, 2,4'-sulfonyldiphenols, and 3,3'-sulfonyldiphenols can be used, preferably the stabilizers are 4,4'-sulfonyldiphenols wherein one or both phenol rings are unsubstituted (other than the hydroxy group) or further substituted with one or more halo, alkyl, alkoxy, cyano, nitro, trihaloalkyl (such as trifluoromethyl), ester, ketone, or haloalkyl groups.

Preferably, the 4,4'-sulfonyldiphenols are represented by the following Structure (SDP):

(SDP)

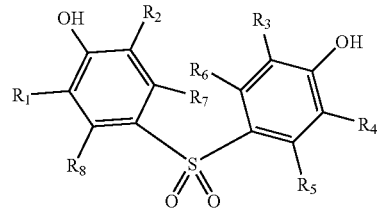

wherein $R_1$ through $R_8$ are independently hydrogen or halo, substituted or unsubstituted alkyl, substituted or unsubstituted alkoxy, cyano, nitro, trihaloalkyl, ester, ketone, or haloalkyl groups. More specifically, these groups can be independently hydrogen, halo groups such as iodo, bromo, or chloro, and substituted alkyl, alkoxy, trihaloalkyl, and haloalkyl groups that can independently have 1 to 10 carbon atoms and be branched, cyclic or linear. Representative alkyl groups include but are not limited to methyl, ethyl, iso-propyl, t-amyl, iso-amyl, t-butyl, n-pentyl, benzyl, cyclohexyl, 4-methylcyclohexyl, and corresponding alkoxy and haloalkyl groups.

In preferred embodiments, $R_1$ through $R_8$ are independently hydrogen or bromo, chloro, methyl, or ethyl groups, and more preferably, $R_1$ through $R_4$ are independently hydrogen or bromo, chloro, methyl, or ethyl groups, and each of $R_5$ through $R_8$ is hydrogen.

Most preferably, $R_1$ through $R_4$ are independently hydrogen or bromo, chloro, or unsubstituted methyl groups, and each of $R_5$ through $R_8$ is hydrogen.

Representative useful 4,4'-sulfonyldiphenols include the following SDP-1 through SDP-5, and SDP-1 and SDP-2 are most preferred:

SDP-1

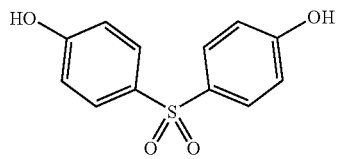

SDP-2

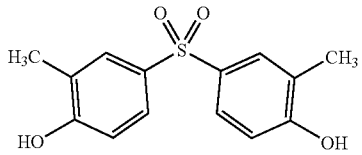

SDP-3

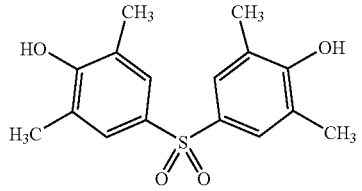

-continued

SDP-4

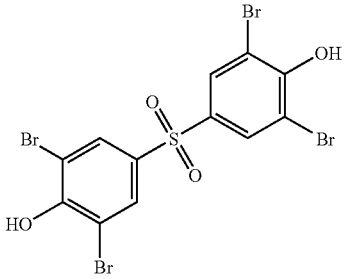

SDP-5

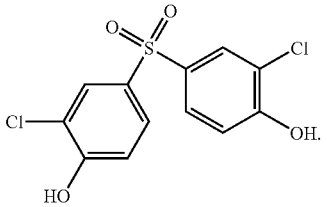

The sulfonyldiphenols useful in this invention can be obtained from several commercial sources such as Aldrich Chemical Company (Milwaukee, Wis.), Alfa Aesar (Ward Hill, Mass.), TCI America (Portland, Oreg.), and ChemService Inc. (West Chester, Pa.).

Other Addenda

The photothermographic can also contain other additives such as shelf-life stabilizers, antifoggants, contrast enhancers (described above), toners, development accelerators, acutance dyes, thermal solvents (also known as melt formers), antistatic or conductive layers, and other image-modifying agents as would be readily apparent to one skilled in the art.

Suitable stabilizers that can be used alone or in combination include thiazolium salts as described in U.S. Pat. Nos. 2,131,038 (Brooker) and 2,694,716 (Allen), azaindenes as described in U.S. Pat. No. 2,886,437 (Piper), triazaindolizines as described in U.S. Pat. No. 2,444,605 (Heimbach), the urazoles described in U.S. Pat. No. 3,287,135 (Anderson), sulfocatechols as described in U.S. Pat. No. 3,235,652 (Kennard), the oximes described in GB 623,448 (Carrol et al.), polyvalent metal salts as described in U.S. Pat. No. 2,839,405 (Jones), thiuronium salts as described in U.S. Pat. No. 3,220,839 (Herz), palladium, platinum, and gold salts as described in U.S. Pat. Nos. 2,566,263 (Trirelli) and 2,597,915 (Damshroder), and the heteroaromatic mercapto compounds or heteroaromatic disulfide compounds described in EP 0 559 228B1 (Philip et al.).

Heteroaromatic mercapto compounds are most preferred. Preferred heteroaromatic mercapto compounds include 2-mercaptobenzimidazole, 2-mercapto-5-methylbenzimidazole, 2-mercaptobenzothiazole and 2-mercapto-benzoxazole, and mixtures thereof. A heteroaromatic mercapto compound is generally present in an emulsion layer in an amount of at least 0.0001 mole (preferably from about 0.001 to about 1.0 mole) per mole of total silver in the emulsion layer.

Other useful antifoggants/stabilizers are described in U.S. Pat. No. 6,083,681 (Lynch et al.). Still other antifoggants are hydrobromic acid salts of heterocyclic compounds (such as pyridinium hydrobromide perbromide) as described in U.S. Pat. No. 5,028,523 (Skoug), benzoyl acid compounds as described in U.S. Pat. No. 4,784,939 (Pham), substituted propenenitrile compounds as described in U.S. Pat. No. 5,686,228 (Murray et al.), silyl blocked compounds as described in U.S. Pat. No. 5,358,843 (Sakizadeh et al.), the 1,3-diaryl-substituted urea compounds described copending and commonly assigned U.S. Ser. No. 11/284,928 (filed Nov. 22, 2005 by Hunt and Sakizadeh), and tribromomethylketones as described in EP 0 600 587A1 (Oliff et al.).

Additives useful as stabilizers for improving dark stability and desktop print stability are the various boron compounds described in U.S. Patent Application Publication 2006/0141404 (Philip et al.). The boron compounds are preferably added in an amount of from about 0.010 to about 0.50 g/m2.

The photothermographic materials preferably also include one or more polyhalogen stabilizers that can be represented by the formula $Q—(Y)_n—C(Z_1Z_2X)$ wherein, Q represents an alkyl, aryl (including heteroaryl) or heterocyclic group, Y represents a divalent linking group, n represents 0 or 1, $Z_1$ and $Z_2$ each represents a halogen atom, and X represents a hydrogen atom, a halogen atom, or an electron-withdrawing group. Particularly useful compounds of this type are polyhalogen stabilizers wherein Q represents an aryl group, Y represents (C═O) or $SO_2$, n is 1, and $Z_1$, $Z_2$, and X each represent a bromine atom. Examples of such compounds containing $—SO_2CBr_3$ groups are described in U.S. Pat. Nos. 3,874,946 (Costa et al.), 5,369,000 (Sakizadeh et al.), 5,374,514 (Kirk et al.), 5,460,938 (Kirk et al.), 5,464,747 (Sakizadeh et al.) and 5,594,143 (Kirk et al.). Examples of such compounds include, but are not limited to, 2-tribromomethylsulfonyl-5-methyl-1,3,4-thiadiazole, 2-tribromomethylsulfonyl-pyridine, 2-tribromomethylsulfonylquinoline, and 2-tribromomethylsulfonyl-benzene. The polyhalogen stabilizers can be present in one or more layers in a total amount of from about 0.005 to about 0.01 mol/mol of total silver, and preferably from about 0.01 to about 0.05 mol/mol of total silver.

"Toners" or derivatives thereof that improve the image are desirable components of the photothermographic materials. These compounds, when added to the imaging layer, shift the color of the image from yellowish-orange to brown-black or blue-black. Generally, one or more toners described herein are present in an amount of from about 0.01% to about 10% (more preferably from about 0.1% to about 10%), based on the total dry weight of the layer in which the toner is included. Toners may be incorporated in the photothermographic emulsion or in an adjacent non-imaging layer.

Compounds useful as toners are described in U.S. Pat. Nos. 3,080,254 (Grant, Jr.), 3,847,612 (Winslow), 4,123,282 (Winslow), 4,082,901 (Laridon et al.), 3,074,809 (Owen), 3,446,648 (Workman), 3,844,797 (Willems et al.), 3,951,660 (Hagemann et al.), 5,599,647 (Defieuw et al.) and GB 1,439,478 (AGFA). Additional useful toners are substituted and unsubstituted mercapto-triazoles as described in U.S. Pat. Nos. 3,832,186 (Masuda et al.), 6,165,704 (Miyake et al.), 5,149,620 (Simpson et al.), 6,713,240 (Lynch et al.), and 6,841,343 (Lynch et al.). Phthalazine and phthalazine derivatives [such as those described in U.S. Pat. No. 6,146,822 (Asanuma et al.)], phthalazinone, and phthalazinone derivatives are particularly useful toners.

Useful phthalazinone compounds are those having sufficient solubility to completely dissolve in the formulation from which they are coated. Preferred phthalazinone compounds include 6,7-dimethoxy-1-(2H)-phthalazinone, 4-(4-pentylphenyl)-1-(2H)-phthalazinone, and 4-(4-cyclohexylphenyl)-1-(2H)-phthalazinone. Mixtures of such phthalazinone compounds can be used if desired.

This combination facilitates obtaining a stable bluish-black image after processing. In preferred embodiments, the molar ratio of hydroxyphthalic acid to phthalazinone is sufficient to provide an a* value more negative than −2 (preferably more negative than −2.5) at an optical density of 1.2 as defined by the CIELAB Color System when the material has been imaged using a thermal print-head from 300 to 400° C. for less than 50 milliseconds (50 msec) and often less than 20 msec. In preferred embodiments, the molar ratio of phthalazinone is to hydroxyphthalic acid about 1:1 to about 3:1. More preferably the ratio is from about 2:1 to about 3:1.

In addition, the imaged material provides an image with an a* value more negative than −1 at an optical density of 1.2 as defined by the CIELAB Color System when the above imaged material is then stored at 70° C. and 30% RH for 3 hours.

The addition of development accelerators that increase the rate of image development and allow reduction in silver coating weight is also useful. Suitable development accelerators include phenols, naphthols, and hydrazine-carboxamides. Such compounds are described, for example, in Y. Yoshioka, K. Yamane, T. Ohzeki, *Development of Rapid Dry Photothermographic Materials with Water-Base Emulsion Coating Method*, AgX 2004: The International Symposium on Silver Halide Technology "At the Forefront of Silver Halide Imaging", Final Program and Proceedings of IS&T and SPSTJ, Ventura, Calif., Sep. 13-15, 2004, pp. 28-31, Society for Imaging Science and Technology, Springfield, Va., U.S. Pat. No. 6,566,042 (Goto et al.), U.S. Patent Application Publications 2004/234906 (Ohzeki et al.), 2005/048422 (Nakagawa), 2005/118542 (Mori et al.), (Nakagawa), and 2006/0014111 (Goto).

Thermal solvents (or melt formers) can also be used, including combinations of such compounds (for example, a combination of succinimide and dimethylurea). Thermal solvents are compounds which are solids at ambient temperature but which melt at the temperature used for processing. The thermal solvent acts as a solvent for various components of the heat-developable photosensitive material, it helps to accelerate thermal development and it provides the medium for diffusion of various materials including silver ions and/or complexes and reducing agents. Known thermal solvents are disclosed in U.S. Pat. Nos. 3,438,776 (Yudelson), 5,064,753 (noted above) 5,250,386 (Aono et al.), 5,368,979 (Freedman et al.), 5,716,772 (Taguchi et al.), and 6,013,420 (Windender). Thermal solvents are also described in U.S. Pat. No. 7,169,544 (Chen-Ho et al.)

The photothermographic materials can also include one or more image stabilizing compounds that are usually incorporated in a "backside" layer. Such compounds can include phthalazinone and its derivatives, pyridazine and its derivatives, benzoxazine and benzoxazine derivatives, benzothiazine dione and its derivatives, and quinazoline dione and its derivatives, particularly as described in U.S. Pat. No. 6,599,685 (Kong). Other useful backside image stabilizers include anthracene compounds, coumarin compounds, benzophenone compounds, benzotriazole compounds, naphthalic acid imide compounds, pyrazoline compounds, or compounds described in U.S. Pat. No. 6,465,162 (Kong et al), and GB 1,565,043 (Fuji Photo).

Phosphors are materials that emit infrared, visible, or ultraviolet radiation upon excitation and can be incorporated into the photothermographic materials. Particularly useful phosphors are sensitive to X-radiation and emit radiation primarily in the ultraviolet, near-ultraviolet, or visible regions of the spectrum (that is, from about 100 to about 700 nm). An intrinsic phosphor is a material that is naturally (that is, intrinsically) phosphorescent. An "activated" phosphor is one composed of a basic material that may or may not be an intrinsic phosphor, to which one or more dopant(s) has been intentionally added. These dopants or activators "activate" the phosphor and cause it to emit ultraviolet or visible radiation. Multiple dopants may be used and thus the phosphor would include both "activators" and "co-activators".

Any conventional or useful phosphor can be used, singly or in mixtures. For example, useful phosphors are described in numerous references relating to fluorescent intensifying screens as well as U.S. Pat. Nos. 6,440,649 (Simpson et al.) and 6,573,033 (Simpson et al.) that are directed to photothermo graphic materials. Some particularly useful phosphors are primarily "activated" phosphors known as phosphate phosphors and borate phosphors. Examples of these phosphors are rare earth phosphates, yttrium phosphates, strontium phosphates, or strontium fluoroborates (including cerium activated rare earth or yttrium phosphates, or europium activated strontium fluoroborates) as described in U.S. Patent Application Publication 2005/0233269 (Simpson et al.).

The one or more phosphors can be present in the photothermo graphic materials in an amount of at least 0.1 mole per mole, and preferably from about 0.5 to about 20 mole, per mole of total silver in the photothermographic material. As noted above, generally, the amount of total silver is at least 0.002 mol/m$^2$. While the phosphors can be incorporated into any imaging layer on one or both sides of the support, it is preferred that they be in the same layer(s) as the photosensitive silver halide(s) on one or both sides of the support Binders The photosensitive silver halide (when present), the non-photo sensitive source of reducible silver ions, the reducing agent composition, the sulfonyldiphenol, and any other imaging layer additives are generally combined with one or more binders that are generally hydrophobic or hydrophilic in nature. Thus, either aqueous or organic solvent-based formulations can be used to prepare the photothermographic materials. Mixtures of either or both types of binders can also be used. It is preferred that the binder be selected from predominantly hydrophobic polymeric materials (at least 50 dry weight % of total binders) that are soluble in organic coating solvents.

Examples of typical hydrophobic binders include polyvinyl acetals, polyvinyl chloride, polyvinyl acetate, cellulose acetate, cellulose acetate butyrate, polyolefins, polyesters, polystyrenes, polyacrylonitrile, polycarbonates, methacrylate copolymers, maleic anhydride ester copolymers, butadiene-styrene copolymers, and other materials readily apparent to one skilled in the art. Copolymers (including terpolymers) are also included in the definition of polymers. The polyvinyl acetals (such as polyvinyl butyral, polyvinyl acetal, and polyvinyl formal) and vinyl copolymers (such as polyvinyl acetate and polyvinyl chloride) are particularly preferred. Particularly suitable hydrophobic binders are polyvinyl butyral resins that are available under the names MOWITAL® (Kuraray America, New York, N.Y.), S-LEC® (Sekisui Chemical Company, Troy, Mich.), BUTVAR® (Solutia, Inc., St. Louis, Mo.) and PIOLOFORM® (Wacker Chemical Company, Adrian, Mich.).

Hydrophilic binders or water-dispersible polymeric latex polymers can also be present in the formulations. Examples of useful hydrophilic binders include, but are not limited to, proteins and protein derivatives, gelatin and gelatin-like derivatives (hardened or unhardened), cellulosic materials such as hydroxymethyl cellulose and cellulosic esters, acrylamide/methacrylamide polymers, acrylic/methacrylic polymers polyvinyl pyrrolidones, polyvinyl alcohols, poly(vinyl lactams), polymers of sulfoalkyl acrylate or methacrylates, hydrolyzed polyvinyl acetates, polyacrylamides, polysaccharides and other synthetic or naturally occurring vehicles commonly known for use in aqueous-based photographic emulsions (see for example, Research Disclosure, item 38957, noted above). Cationic starches can also be used as a peptizer for tabular silver halide grains as described in U.S. Pat. Nos. 5,620,840 (Maskasky) and 5,667,955 (Maskasky).

One embodiment of the polymers capable of being dispersed in and coated out of an aqueous solvent includes hydrophobic polymers such as acrylic polymers, poly(ester), rubber (e.g., SBR resin), poly(urethane), poly(vinyl chloride), poly(vinyl acetate), poly(vinylidene chloride), poly (olefin), and the like. As the polymers above, usable are straight chain polymers, branched polymers, or crosslinked polymers. Also usable are the so-called homopolymers in which single monomer is polymerized, or copolymers in which two or more types of monomers are polymerized. In the case of a copolymer, it may be a random copolymer or a block copolymer. The molecular weight of these polymers is, in number average molecular weight, in the range from 5,000 to 1,000,000, preferably from 10,000 to 200,000. Those having too small molecular weight exhibit insufficient mechanical strength on forming the image-forming layer, and those having too large molecular weight are also not preferred because the filming properties result poor. Further, crosslinking polymer latexes are particularly preferred for use. Specific examples of preferred polymer latexes include:

- Latex of methyl methacrylate (70)-ethyl acrylate (27)-methacrylic acid (3).
- Latex of methyl methacrylate (70)-2-ethylhexyl acrylate (20)-styrene (5)-acrylic acid (5).
- Latex of styrene (50)-butadiene (47)-methacrylic acid (3).
- Latex of styrene (68)-butadiene (29)-acrylic acid (3).
- Latex of styrene (71)-butadiene (26)-acrylic acid (3).
- Latex of styrene (70)-butadiene (27)-itaconic acid (3).
- Latex of styrene (75)-butadiene (24)-acrylic acid (1).
- Latex of styrene (60)-butadiene (35)-divinylbenzene (3)-methacrylic acid (2).
- Latex of styrene (70)-butadiene (25)-divinylbenzene (2)-acrylic acid (3).
- Latex of vinyl chloride (50)-methyl methacrylate (20)-ethyl acrylate (20)-acrylonitrile (5)-acrylic acid (5).
- Latex of vinylidene chloride (85)-methyl methacrylate (5)-ethyl acrylate (5)-methacrylic acid (5).
- Latex of ethylene (90)-methacrylic acid (10).
- Latex of styrene (70)-2-ethylhexyl acrylate (27)-acrylic acid (3).
- Latex of methyl methacrylate (63)-ethyl acrylate (35)-acrylic acid (2).
- Latex of styrene (70.5)-butadiene (26.5)-acrylic acid (3).
- Latex of styrene (69.5)-butadiene (27.5)-acrylic acid (3)

The numbers in parenthesis represent weight %. The polymer latexes above are commercially available. They may be used alone, or may be used by blending two or more types.

Styrene-butadiene copolymers are particularly preferable when polymer latexes are used as binders. The weight ratio of monomer unit for styrene to that of butadiene constituting the styrene-butadiene copolymer is preferably in the range of from 40:60 to 95:5. Further, the monomer unit of styrene and that of butadiene preferably account for 60% by weight to 99% by weight with respect to the copolymer. Moreover, the polymer latex contains acrylic acid or methacrylic acid, preferably, in the range from 1% by weight to 6% by weight, and more preferably, from 2% by weight to 5% by weight, with respect to the total weight of the monomer unit of styrene and that of butadiene. The preferred range of the molecular weight is the same as that described above.

Preferred latexes include styrene (50)-butadiene (47)-methacrylic acid (3), styrene (60)-butadiene (35)-divinylbenzene-methyl methacrylate (3)-methacrylic acid (2), styrene (70.5)-butadiene (26.5)-acrylic acid (3) and commercially available LACSTAR-3307B, 7132C, and Nipol Lx416. Such latexes are described in U.S. Patent Application Publication 2005/0221237 (Sakai et al.) that is incorporated herein by reference.

Hardeners for various binders may be present if desired. Useful hardeners are well known and include diisocyanate compounds as described in EP 0 600 586 B1 (Philip, Jr. et al.), vinyl sulfone compounds as described in U.S. Pat. No. 6,143,487 (Philip, Jr. et al.) and EP 0 640 589 A1 (Gathmann et al.), aldehydes and various other hardeners as described in U.S. Pat. No. 6,190,822 (Dickerson et al.). The hydrophilic binders used in the thermally developable materials are generally partially or fully hardened using any conventional hardener. Useful hardeners are well known and are described, for example, in T. H. James, *The Theory of the Photographic Process*, Fourth Edition, Eastman Kodak Company, Rochester, N.Y., 1977, Chapter 2, pp. 77-8.

Where the proportions and activities of the photothermographic materials require a particular developing time and temperature, the binder(s) should be able to withstand those conditions. When a hydrophobic binder is used, it is preferred that the binder (or mixture thereof) does not decompose or lose its structural integrity at 120° C. for 60 seconds. When a hydrophilic binder is used, it is preferred that the binder does not decompose or lose its structural integrity at 150° C. for 60 seconds. It is more preferred that the binder not decompose or lose its structural integrity at 177° C. for 60 seconds.

The polymer binder(s) is used in an amount sufficient to carry the components dispersed therein. Preferably, a binder is used at a level of from about 10% to about 90% by weight (more preferably at a level of from about 20% to about 70% by weight) based on the total dry weight of the layer. It is particularly useful that the photothermographic materials include at least 50 weight % hydrophobic binders coatable out of organic solvents in both imaging and non-imaging layers on both sides of the support (and particularly the imaging side of the support).

Support Materials

The photothermographic materials comprise a polymeric support that is preferably a flexible, transparent film that has any desired thickness and is composed of one or more polymeric materials. They are required to exhibit dimensional stability during thermal development and to have suitable adhesive properties with overlying layers. Useful polymeric materials for making such supports include polyesters [such as poly(ethylene terephthalate) and poly(ethylene naphthalate)], cellulose acetate and other cellulose esters, polyvinyl acetal, polyolefins, polycarbonates, and polystyrenes. Preferred supports are composed of polymers having good heat stability, such as polyesters and polycarbonates. Support materials may also be treated or annealed to reduce shrinkage and promote dimensional stability.

It is also useful to use transparent, multilayer, polymeric supports comprising numerous alternating layers of at least two different polymeric materials as described in U.S. Pat. No. 6,630,283 (Simpson et al.). Another support comprises dichroic mirror layers as described in U.S. Pat. No. 5,795,708 (Boutet).

Opaque supports can also be used, such as dyed polymeric films and resin-coated papers that are stable to high temperatures.

Support materials can contain various colorants, pigments, antihalation or acutance dyes if desired. For example, the support can include one or more dyes that provide a blue color in the resulting imaged film. Support materials may be treated using conventional procedures (such as corona discharge) to improve adhesion of overlying layers, or subbing or other adhesion-promoting layers can be used.

Photothermographic Formulations and Constructions

An organic solvent-based coating formulation for the photothermo graphic emulsion layer(s) and other layers in the photothermographic material can be prepared by mixing the various components with one or more hydrophobic binders in a suitable organic solvent system that usually includes one or more solvents such as toluene, 2-butanone (methyl ethyl ketone), acetone, or tetrahydrofuran, or mixtures thereof. Methyl ethyl ketone is a preferred coating solvent. Non-imaging layers on the imaging side include protective overcoats, interlayers between the protective overcoat and one or more emulsion layer, and carrier layers underneath the emulsion layers, all of which can be formulated using the appropriate solvents and components.

Alternatively, the desired imaging components can be formulated with a hydrophilic binder (such as gelatin, or a gelatin-derivative), or a hydrophobic water-dispersible polymer latex (such as a styrene-butadiene latex) in water or water-organic solvent mixtures to provide aqueous-based coating formulations.

The photothermographic materials can contain plasticizers and lubricants such as poly(alcohols) and diols as described in U.S. Pat. No. 2,960,404 (Milton et al.), fatty acids or esters as described in U.S. Pat. Nos. 2,588,765 (Robijns) and 3,121,060 (Duane), and silicone resins as described in GB 955,061 (DuPont). The materials can also contain inorganic and organic matting agents as described in U.S. Pat. Nos. 2,992,101 (Jelley et al.) and 2,701,245 (Lynn). Polymeric fluorinated surfactants may also be useful in one or more layers as described in U.S. Pat. No. 5,468,603 (Kub).

The photothermographic materials preferably include a surface protective layer over the one or more emulsion layers. Layers to reduce emissions from the material may also be present, including the polymeric barrier layers described in U.S. Pat. Nos. 6,352,819 (Kenney et al.), 6,352,820 (Bauer et al.), 6,420,102 (Bauer et al.), 6,667,148 (Rao et al.), and 6,746,831 (Hunt).

U.S. Pat. No. 6,436,616 (Geisler et al.) describes various means of modifying photothermographic materials to reduce what is known as the "woodgrain" effect, or uneven optical density.

To promote image sharpness, the photothermographic materials can contain one or more layers containing acutance and/or antihalation dyes. These dyes are chosen to have absorption close to the exposure wavelength and are designed to absorb scattered light. One or more antihalation compositions may be incorporated into the support, backside layers, underlayers, or overcoat layers. Additionally, one or more acutance dyes may be incorporated into one or more frontside imaging layers.

Dyes useful as antihalation and acutance dyes include squaraine dyes as described in U.S. Pat. Nos. 5,380,635 (Gomez et al.), and 6,063,560 (Suzuki et al.), and EP 1 083 459A1 (Kimura), indolenine dyes as described in EP 0 342 810A1 (Leichter), and cyanine dyes as described in U.S. Pat. No. 6,689,547 (Hunt et al.).

It may also be useful to employ compositions including acutance or antihalation dyes that will decolorize or bleach with heat during processing as described in U.S. Pat. Nos. 5,135,842 (Kitchin et al.), 5,266,452 (Kitchin et al.), 5,314,795 (Helland et al.), and 6,306,566, (Sakurada et al.), and Japan Kokai 2001-142175 (Hanyu et al.) and 2001-183770 (Hanyu et al.). Useful bleaching compositions are described in Japan Kokai 11-302550 (Fujiwara), 2001-109101 (Adachi), 2001-51371 (Yabuki et al.), and 2000-029168 (Noro).

Other useful heat-bleachable antihalation compositions can include an infrared radiation absorbing compound such as an oxonol dye or various other compounds used in combination with a hexaarylbiimidazole (also known as a "HABI"), or mixtures thereof. HABI compounds are described in U.S. Pat. Nos. 4,196,002 (Levinson et al.), 5,652,091 (Perry et al.), and 5,672,562 (Perry et al.). Examples of such heat-bleachable compositions are described for example in U.S. Pat. Nos. 6,455,210 (Irving et al.), 6,514,677 (Ramsden et al.), and 6,558,880 (Goswami et al.).

Under practical conditions of use, these compositions are heated to provide bleaching at a temperature of at least 90° C. for at least 0.5 seconds (preferably, at a temperature of from about 100° C. to about 200° C. for from about 5 to about 20 seconds).

Mottle and other surface anomalies can be reduced by incorporating a fluorinated polymer as described, for example, in U.S. Pat. No. 5,532,121 (Yonkoski et al.) or by using particular drying techniques as described, for example in U.S. Pat. No. 5,621,983 (Ludemann et al.).

It is preferable for the photothermographic material to include one or more radiation absorbing substances that are generally incorporated into one or more photothermographic layer(s)to provide a total absorbance of all layers on that side of the support of at least 0.1 (preferably of at least 0.6) at the exposure wavelength of the photothermographic material. Where the imaging layers are on one side of the support only, it is also desired that the total absorbance at the exposure wavelength for all layers on the backside (non-imaging) side of the support be at least 0.2.

Photothermographic formulations of can be coated by various coating procedures including wire wound rod coating, dip coating, air knife coating, curtain coating, slide coating, or extrusion coating using hoppers of the type described in U.S. Pat. No. 2,681,294 (Beguin). Layers can be coated one at a time, or two or more layers can be coated simultaneously by the procedures described in U.S. Pat. Nos. 2,761,791 (Russell), 4,001,024 (Dittman et al.), 4,569,863 (Keopke et al.), 5,340,613 (Hanzalik et al.), 5,405,740 (LaBelle), 5,415,993 (Hanzalik et al.), 5,525,376 (Leonard), 5,733,608 (Kessel et al.), 5,849,363 (Yapel et al.), 5,843,530 (Jerry et al.), and 5,861,195 (Bhave et al.), and GB 837,095

(Ilford). A typical coating gap for the emulsion layer can be from about 10 to about 750 μm, and the layer can be dried in forced air at a temperature of from about 20° C. to about 100° C. It is preferred that the thickness of the layer be selected to provide maximum image densities greater than about 0.2, and more preferably, from about 0.5 to 5.0 or more, as measured by an X-rite Model 361/V Densitometer equipped with 301 Visual Optics, available from X-rite Corporation, (Granville, Mich.).

Preferably, two or more layer formulations are simultaneously applied to a support using slide coating, the first layer being coated on top of the second layer while the second layer is still wet. The first and second fluids used to coat these layers can be the same or different solvents. For example, subsequently to, or simultaneously with, application of the emulsion formulation(s) to the support, a protective overcoat formulation can be applied over the emulsion formulation. Simultaneous coating can be used to apply layers on the frontside, backside, or both sides of the support.

In other embodiments, a "carrier" layer formulation comprising a single-phase mixture of two or more polymers described above may be applied directly onto the support and thereby located underneath the emulsion layer(s) as described in U.S. Pat. No. 6,355,405 (Ludemann et al.). The carrier layer formulation can be simultaneously applied with application of the emulsion layer formulation(s) and any overcoat or surface protective layers.

The photothermographic materials can include one or more antistatic or conductive layers agents in any of the layers on either or both sides of the support. Conductive components include soluble salts, evaporated metal layers, or ionic polymers as described in U.S. Pat. Nos. 2,861,056 (Minsk) and 3,206,312 (Sterman et al.), insoluble inorganic salts as described in U.S. Pat. No. 3,428,451 (Trevoy), electroconductive underlayers as described in U.S. Pat. No. 5,310,640 (Markin et al.), electronically-conductive metal antimonate particles as described in U.S. Pat. No. 5,368,995 (Christian et al.), and electrically-conductive metal-containing particles dispersed in a polymeric binder as described in EP 0 678 776 A1 (Melpolder et al.). Particularly useful conductive particles are the non-acicular metal antimonate particles used in a buried backside conductive layer as described and in U.S. Pat. Nos. 6,689,546 (LaBelle et al.), 7,018,787 (Ludemann et al.), and 7,022,467 (Ludemann et al.) and in U.S. Patent Application Publications 2006/0046215 (Ludemann et al.), 2006/0046932, and 2006/0093973 (Ludemann et al.).

It is particularly useful that the conductive layers be disposed on the backside of the support and especially where they are buried or underneath one or more other layers such as backside protective layer(s). Such backside conductive layers typically have a resistivity of about $10^5$ to about $10^{12}$ ohm/sq as measured using a salt bridge water electrode resistivity measurement technique. This technique is described in R. A. Elder *Resistivity Measurements on Buried Conductive Layers*, EOS/ESD Symposium Proceedings, Lake Buena Vista, Fla., 1990, pp. 251-254, incorporated herein by reference. [EOS/ESD stands for Electrical Overstress/Electrostatic Discharge].

Still other conductive compositions include one or more fluoro-chemicals each of which is a reaction product of $R_f$—$CH_2CH_2$—$SO_3H$ with an amine wherein $R_f$ comprises 4 or more fully fluorinated carbon atoms as described in U.S. Pat. No. 6,699,648 (Sakizadeh et al.). Additional conductive compositions include one or more fluorochemicals described in more detail in U.S. Pat. No. 6,762,013 (Sakizadeh et al.).

The photothermographic materials may also usefully include a magnetic recording material as described in *Research Disclosure*, Item 34390, November 1992, or a transparent magnetic recording layer such as a layer containing magnetic particles on the underside of a transparent support as described in U.S. Pat. No. 4,302,523 (Audran et al.).

While the carrier and emulsion layers can be coated on one side of the film support, manufacturing methods can also include forming on the opposing or backside of the polymeric support, one or more additional layers, including a conductive layer, antihalation layer, or a layer containing a matting agent (such as silica), or a combination of such layers. Alternatively, one backside layer can perform all of the desired functions.

In a preferred construction, a conductive "carrier" layer formulation comprising a single-phase mixture of two or more polymers and non-acicular metal antimonate particles, may be applied directly onto the backside of the support and thereby be located underneath other backside layers. The carrier layer formulation can be simultaneously applied with application of these other backside layer formulations.

Layers to promote adhesion of one layer to another are also known, such as those described in U.S. Pat. Nos. 5,891,610 (Bauer et al.), 5,804,365 (Bauer et al.), and 4,741,992 (Przezdziecki). Adhesion can also be promoted using specific polymeric adhesive materials as described in U.S. Pat. No. 5,928,857 (Geisler et al.).

It is also contemplated that the photothermographic materials include one or more photothermographic layers on both sides of the support and/or an antihalation underlayer beneath at least one photothermographic layer on at least one side of the support. In addition, the materials can have an outermost protective layer disposed over all photothermographic layers on both sides of the support.

Imaging/Development

The photothermographic materials can be imaged in any suitable manner consistent with the type of material, using any suitable imaging source to which they are sensitive (typically some type of radiation or electronic signal). In most embodiments, the materials are sensitive to radiation in the range of from about at least 100 nm to about 1400 nm. In some embodiments, they materials are sensitive to radiation in the range of from about 300 nm to about 600 nm, more preferably from about 300 to about 450 nm, even more preferably from a wavelength of from about 360 to 420 nm. In preferred embodiments the materials are sensitized to radiation from about 600 to about 1200 nm and more preferably to infrared radiation from about 700 to about 950 nm. If necessary, sensitivity to a particular wavelength can be achieved by using appropriate spectral sensitizing dyes.

Imaging can be carried out by exposing the photothermographic materials to a suitable source of radiation to which they are sensitive, including X-radiation, ultraviolet radiation, visible light, near infrared radiation, and infrared radiation to provide a latent image. Suitable exposure means are well known and include phosphor emitted radiation (particularly X-ray induced phosphor emitted radiation), incandescent or fluorescent lamps, xenon flash lamps, lasers, laser diodes, light emitting diodes, infrared lasers, infrared laser diodes, infrared light-emitting diodes, infrared lamps, or any other ultraviolet, visible, or infrared radiation source readily apparent to one skilled in the art such as described in *Research Disclosure, item* 38957 (noted above). Particularly useful infrared exposure means include laser diodes emitting at from about 700 to about 950 nm, including laser diodes that are modulated to increase imaging efficiency using what is known as multi-longitudinal exposure techniques as described in U.S. Pat. No. 5,780,207 (Mohapatra et al.). Other exposure techniques are described in U.S. Pat. No. 5,493,327 (McCallum et al.).

The photothermographic materials also can be indirectly imaged using an X-radiation imaging source and one or more prompt-emitting or storage X-radiation sensitive phosphor screens adjacent to the photothermographic material. The phosphors emit suitable radiation to expose the photothermographic material. Preferred X-ray screens are those having phosphors emitting in the near ultraviolet region of the spectrum (from 300 to 400 nm), in the blue region of the spectrum (from 400 to 500 nm), and in the green region of the spectrum (from 500 to 600 nm).

In other embodiments, the photothermographic materials can be imaged directly using an X-radiation imaging source to provide a latent image.

Thermal development conditions will vary, depending on the construction used but will typically involve heating the imagewise exposed photo thermographic material at a suitably elevated temperature, for example, at from about 50° C. to about 250° C. (preferably from about 80° C. to about 200° C. and more preferably from about 100° C. to about 200° C.) for a sufficient period of time, generally from about 1 to about 120 seconds. Heating can be accomplished using any suitable heating means such as contacting the material with a heated drum, plates, or rollers, or by providing a heating resistance layer on the rear surface of the material and supplying electric current to the layer so as to heat the material. A preferred heat development procedure for photothermographic materials includes heating within a temperature range of from 110 to 150° C. for 25 seconds or less, for example, at least 3 and up to 25 seconds (and preferably for 20 seconds or less) to develop the latent image into a visible image having a maximum density (Dmax) of at least 3.0. Line speeds during development of greater than 61 cm/min, such as from 61 to 200 cm/min, can be used.

Thermal development of photothermographic materials is carried out with the material being in a substantially water-free environment and without application of any solvent to the material.

Use as a Photomask

The photothermographic materials can be sufficiently transmissive in the range of from about 350 to about 450 nm in non-imaged areas to allow their use in a method where there is a subsequent exposure of an ultraviolet or short wavelength visible radiation sensitive imageable medium. The photothermographic materials absorb ultraviolet or short wavelength visible radiation in the areas where there is a visible image and transmit ultraviolet or short wavelength visible radiation where there is no visible image. The photothermographic materials may then be used as a mask and positioned between a source of imaging radiation (such as an ultraviolet or short wavelength visible radiation energy source) and an imageable material that is sensitive to such imaging radiation, such as a photopolymer, diazo material, photoresist, or photosensitive printing plate. Exposing the imageable material to the imaging radiation through the visible image in the exposed and heat-developed photo thermographic material provides an image in the imageable material. This method is particularly useful where the imageable medium comprises a printing plate and the photothermographic material serves as an image-setting film.

Thus, in some other embodiments wherein the photothermographic material comprises a transparent support, the image-forming method further comprises, after steps (A) and (B) noted above:

(C) positioning the exposed and heat-developed photothermographic material between a source of imaging radiation and an imageable material that is sensitive to the imaging radiation, and (D) exposing the imageable material to the imaging radiation through the visible image in the exposed and heat-developed photothermographic material to provide an image in the imageable material.

The following examples are provided to illustrate the practice of the present invention and the invention is not meant to be limited thereby.

Materials and Methods for the Examples:

All materials used in the following examples are readily available from standard commercial sources, such as Aldrich Chemical Co. (Milwaukee Wis.) unless otherwise specified. All percentages are by weight unless otherwise indicated. The following additional terms and materials were used.

Many of the chemical components used herein are provided as a solution. The term "active ingredient" means the amount or the percentage of the desired chemical component contained in a sample. All amounts listed herein are the amount of active ingredient added unless otherwise specified.

ACRYLOID® A-21 or PARALOID® A-21 is an acrylic copolymer available from Rohm and Haas (Philadelphia, Pa.).

CAB 171-15S is a cellulose acetate butyrate resin available from Eastman Chemical Co (Kingsport, Tenn.).

DESMODUR® N3300 is a trimer of an aliphatic hexamethylene diisocyanate available from Bayer Chemicals (Pittsburgh, Pa.).

LOWINOX® 221B446 is 2,2'-isobutylidene-bis(4,6-dimethyl-phenol) available from Great Lakes Chemical (West Lafayette, Ind.).

PIOLOFORM® BL-16 is reported to be a polyvinyl butyral resin having a glass transition temperature of about 84° C. PIOLOFORM® BM-18 is reported to be a polyvinyl butyral resin having glass transition temperature of about 70° C. Both are available from Wacker Polymer Systems (Adrian, Mich.).

MEK is methyl ethyl ketone (or 2-butanone).

CAO5 has the following structure:

(CAO5)

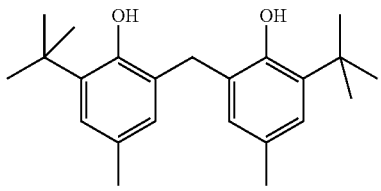

Irganox 1010 has the following structure:

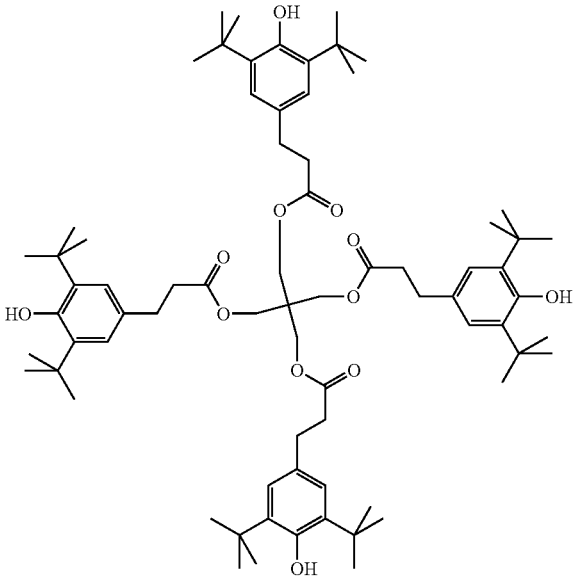

(Irganox® 1010)

Vinyl Sulfone-1 (VS-1) is described in U.S. Pat. No. 6,143,487 and has the structure shown below.

(VS-1)

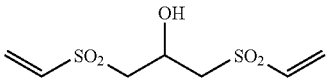

Antifoggant A is 2-Pyridyl tribromomethylsulfone and has the structure shown below.

(AF-A)

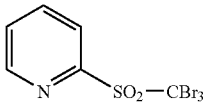

Acutance Dye AD-1 has the following structure:

(AD-1)

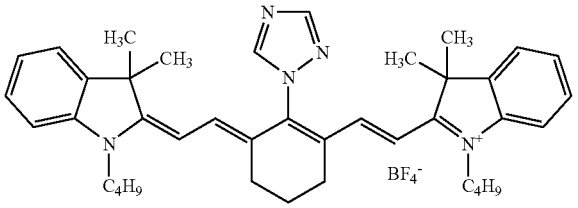

Tinting Dye TD-1 has the following structure:

(TD-1)

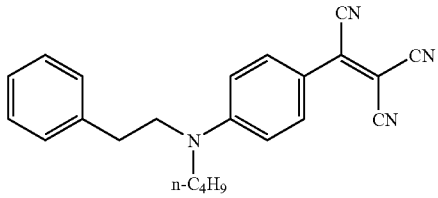

Sensitizing Dye A has the structure shown below.

(Sensitizing Dye A)

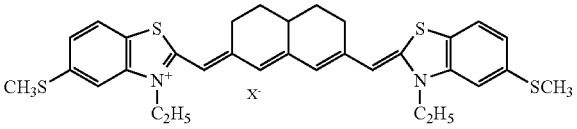

Antifoggant B is ethyl-2-cyano-3-oxobutanoate and has the structure shown below.

(AF-B)

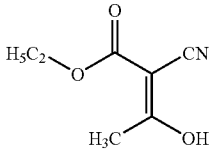

Support Dye SD-1 has the following structure:

(SD-1)

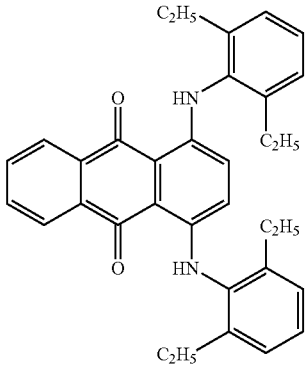

KS-3 is described in U.S. Pat. No. 6,171,767 and has the following structure.

(KS-3)

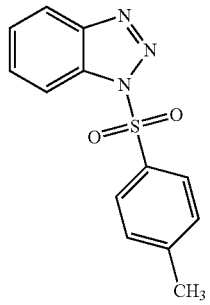

Comparative Compound 1 (CC-1) has the following structure:

(CC-1)

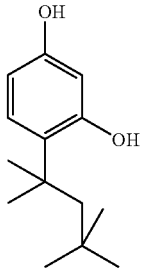

EXAMPLE 1

Preparation of PhotothermoGraphic Emulsion Formulation

A photothermographic emulsion formulation was prepared as follows:

A preformed silver halide, silver carboxylate soap dispersion, was prepared in a similar fashion to that described in U.S. Pat. No. 5,939,249 (noted above). The core shell silver halide emulsion had a silver iodobromide core with 8% iodide, and a silver bromide shell doped with iridium and copper. The core made up 25% of each silver halide grain, and the shell made up the remaining 75%. The silver halide grains were cubic in shape, and had a mean grain size between 0.055 and 0.06 μm. The preformed silver halide, silver carboxylate soap dispersion was made by mixing 26.1% preformed silver halide, silver carboxylate soap, 2.1% PIOLOFORM® BM-18 polyvinyl butyral binder, and 71.8% MEK, and homogenizing three times at 8000 psi (55 MPa).

A photothermographic emulsion formulation was prepared containing 174 parts of the above preformed silver halide, silver carboxylate soap dispersion. To this formulation was added 1.6 parts of a 15% solution of pyridinium hydrobromide perbromide in methanol, with stirring. After 60 minutes of mixing, 2.1 parts of an 11% zinc bromide solution in methanol was added. Stirring was continued and after 30 minutes, a solution of 0.15 parts 2-mercapto-5-methylbenzimidazole, 0.007 parts of Sensitizing Dye A, 1.7 parts of 2-(4-chlorobenzoyl)benzoic acid, 10.8 parts of methanol, and 3.8 parts of MEK were added. After stirring for 75 minutes, the temperature was lowered to 10° C., and 26 parts of PIOLOFORM® BM 18 and 20 parts of PIOLOFORM® BL 16 were added. Mixing was continued for another 30 minutes.

The formulation was formed by mixing the materials shown below. Five minutes were allowed between the additions of each component.

| | |
|---|---|
| Antifoggant (AF-A) | 0.80 parts |
| Tetrachlorophthalic acid (TCPA) | 0.37 parts |
| 4-Methylphthalic acid (4 MPA) | 0.72 parts |
| MEK | 21 parts |
| Methanol | 0.36 parts |
| LOWINOX ® 221B446 | 9.5 parts |
| DESMODUR ® N3300 | 0.66 parts in 0.33 parts MEK |
| Phthalazine (PHZ) | 1.3 parts in 6.3 parts MEK |
| Additional compound | See TABLE 1 |

Topcoat Formulation:

Topcoat formulations were prepared by mixing the following materials:

| | |
|---|---|
| MEK | 92 parts |
| PARALOID ® A-21 | 0.59 parts |
| CAB 171-15S | 6.4 parts |
| Vinyl sulfone VS-1 | 0.24 parts |
| Benzotriazole (BZT) | 0.18 parts |
| Acutance Dye AD-1 | 0.09 parts |
| Antifoggant AF-B | 0.16 parts |
| DESMODUR ® N3300 | 0.48 parts |
| Tinting Dye TD-1 | 0.004 parts |

The photothermographic emulsion and topcoat formulations were simultaneously coated onto a 7 mil (178 μm) polyethylene terephthalate support, tinted blue with support dye SD-1. An automated dual knife coater equipped with an in-line dryer was used. Immediately after coating, samples were dried in a forced air oven at between 80 and 95° C. for between 4 and 5 minutes. The photothermographic emulsion formulation was coated to obtain a coating weight of between about 1.65 and 2.6 g of total silver/$m^2$ (between about 0.0153 and 0.0242 mol/$m^2$). The topcoat formulation was coated to obtain about a dry coating weight of about 0.2 g/$ft^2$ (2.2 g/$m^2$) and an optical density (absorbance) in the imaging layer of about 1.0 at 810 nm.

The backside of the support had been coated with an antihalation and antistatic layer having an absorbance greater than 0.3 between 805 and 815 nm, and a resistivity of less than $10^{11}$ ohms/square.

Two comparative samples were prepared: Sample 1-1-Comparative contained no inventive compound and Sample 1-2-Comparative contained the comparative compound CC-1. Four inventive samples were prepared containing an increasing level of sulfonyldiphenol compound SDP-1 as shown in TABLE I.

Samples of each photothermographic material were cut into strips, exposed with a laser sensitometer at 810 nm, and thermally developed to generate continuous tone wedges with image densities varying from a minimum density (Dmin) to a maximum density (Dmax) possible for the exposure source and development conditions. Development was carried out on a 6-inch diameter (15.2-cm) heated rotating drum. The strip contacted the drum for 210 degrees of its revolution, about 11 inches (28 cm), at 122.5° C. for 15 seconds at a rate of 0.733 inches/sec (112 cm/min). These samples provided initial $D_{min}$, $D_{max}$, and Relative Speed-2 and are shown in TABLE I.

Densitometry measurements were made on a custom built computer-scanned densitometer meeting ISO Standards 5-2 and 5-3 and are believed to be comparable to measurements from commercially available densitometers. Density of the wedges was measured with above computer densitometer using a filter appropriate to the sensitivity of the photothermographic material to obtain graphs of density versus log exposure (that is, D log E curves). Dmin is the density of the non-exposed areas after development and it is the average of the eight lowest density values. Relative Speed-2 is determined at a density value of 1.00 above Dmin and then normalized against Sample 1-1-Comparative, which was assigned a Relative Speed-2 value of 100.

Post-Process Hot-Dark Stability Test:

The continuous tone wedge strip samples for each photothermo graphic coating and processing conditions prepared above were scanned using the computer densitometer with a blue filter with a transmission peak at about 440 nm, and the blue density of the image was recorded. Each sample was then illuminated with fluorescent lighting for 3 hours at 21° C./50% relative humidity. The illumination at the surface of each strip was 90 to 120 foot candles (968-1291 lux). The testing samples were then packaged in a high-density, flat-black polyethylene bag with three strips of polyethylene terephthalate film support placed above and below the stack of film samples. The bagged samples were then placed in a 68-74° C. oven for either 3 hours or 20 hours, as indicated, followed by re-scanning with the same densitometer and blue filter. The change in density at initial $D_{min}$ and the maximal density change across the continuous tone wedge were calculated by subtracting the blue density of the initial sample from the blue density of the sample after testing as shown in TABLE I. These two parameters can define high temperature post-processing stability. The change in Dmin and the maximum density change for Sample 1-1-Comparative were each assigned a relative value of 100. The changes for all other Comparative and Inventive Samples are shown as ratios to Sample 1-1-Comparative.

The results, shown below in TABLE 1, demonstrate that the use of sulfonyldiphenol compound SDP-1 improved post-processing hot-dark stability of the photothermographic imaging materials. Compared with the Sample 1-1-Comparative that contained no sulfonyldiphenol, Samples 1-3-Inventive to 1-6-Inventive having an increasing level of SDP-1 in the photothermographic layer, exhibited less change in $D_{min}$ and the maximum density change after Hot-Dark Stability Tests, without significant loss in desired sensitometric properties such as $D_{min}$, $D_{max}$ and Relative Speed-2. On the other hand, Sample 1-2-Comparative containing the comparative compound CC-1 showed no improvement in post-processing hot-dark stability.

EXAMPLE 2

A photothermographic imaging formulation was prepared as described in Example 1 except the following:

A preformed silver halide, silver carboxylate soap dispersion, was prepared in a similar fashion to that described in U.S. Pat. No. 5,939,249 (noted above). The silver halide emulsion had a silver iodobromide uniform core and shell, with 2% iodide, and was doped with iridium and copper. The silver halide grains were cubic in shape, and had a mean grain size of 0.04 μm. The preformed silver halide, silver carboxylate soap dispersion was made by mixing 26.1% preformed silver halide, silver carboxylate soap, 2.1% PIOLOFORM® BM-18 polyvinyl butyral binder, and 71.8% MEK, and homogenizing three times at 8000 psi (55 MPa).

The photothermographic emulsion formulation was prepared with the above preformed silver halide, silver carboxylate soap dispersion as described in Example 1 except using 4.7 parts of CAO5 and 12.3 parts of Irganox® 1010. The topcoat formulation was prepared as described in Example 1. The photothermographic materials were developed and evaluated as described in Example 1. A comparative sample, Sample 2-1-Comparative, was prepared containing no sulfonyldiphenol. The Relative Speed-2, the change in density at initial $D_{min}$, and the maximum density change after 3 hour Hot-Dark Stability Test for Sample 2-1-Comparative were each assigned a relative value of 100. Two inventive samples were prepared containing an increasing level of SDP-1 as shown in TABLE II. The Relative Speed-2, the change in density at initial $D_{min}$, and the maximum density change after 3 hour Hot-Dark Stability Test for inventive samples are shown as ratios to Sample 2-1-Comparative in TABLE II.

The results, shown below in TABLE II, demonstrate that the use of the sulfonyldiphenol compound SDP-1 improved post-processing hot-dark stability of photothermographic imaging materials with different developers and silver halide grains. Compared with the Sample 2-1-Comparative that contained no sulfonyldiphenol, Samples 2-2-Inventive and 2-3-Inventive having an increasing level of SDP-1 in the photothermographic layer exhibited less change at initial $D_{min}$ and the maximum density change after 3 hour Hot-Dark Stability Test, without significant loss in desired sensitometric properties such as $D_{min}$, $D_{max}$, and Relative Speed-2.

TABLE I

| | | | Initial Sensitometry | | | 3 hour Hot-dark Stability Test | | 20 hour Hot-Dark Stability Test | |
|---|---|---|---|---|---|---|---|---|---|
| Sample | Additional Compound | Amount of Additional Compound (mol/m$^2$) | $D_{min}$ | $D_{max}$ | Relative Speed-2 | Relative Change in $D_{min}$ | Relative Maximum Change in Density | Relative Change in $D_{min}$ | Relative Maximum Change in Density |
| 1-1-Comparative | None | 0 | 0.211 | 3.80 | 100 | 100 | 100 | 100 | 100 |
| 1-2-Comparative | CC-1 | $4.6 \times 10^{-4}$ | 0.212 | 3.83 | 100 | 110 | 102 | 105 | 101 |
| 1-3-Inventive | SDP-1 | $1.5 \times 10^{-4}$ | 0.210 | 3.80 | 101 | 65 | 78 | 15 | 92 |
| 1-4-Inventive | SDP-1 | $3.1 \times 10^{-4}$ | 0.214 | 3.79 | 102 | 64 | 62 | 11 | 85 |
| 1-5-Inventive | SDP-1 | $4.6 \times 10^{-4}$ | 0.210 | 3.79 | 101 | 56 | 39 | 8 | 67 |
| 1-6-Inventive | SDP-1 | $6.1 \times 10^{-4}$ | 0.211 | 3.85 | 102 | 50 | 32 | 5 | 57 |

TABLE II

| Sample | Additional Compound | Amount of Additional Compound (mol/m$^2$) | Initial $D_{min}$ | Initial $D_{max}$ | Initial Relative Speed-2 | Relative Change in $D_{min}$ | Relative Maximum Change in Density |
|---|---|---|---|---|---|---|---|
| 2-1-Comparative | None | 0 | 0.213 | 3.86 | 100 | 100 | 100 |
| 2-2-Inventive | SDP-1 | $3.1 \times 10^{-4}$ | 0.211 | 3.79 | 98 | 33 | 17 |
| 2-3-Inventive | SDP-1 | $4.6 \times 10^{-4}$ | 0.210 | 3.78 | 97 | 28 | 10 |

EXAMPLE 3

The photothermographic imaging formulation was prepared as described in Example 2 except for the following. The photothermographic emulsion formulation contained 3.8 parts of CAO5 and 7.5 parts of Irganox 1010.

Topcoat formulations were prepared by mixing the following components. The sulfonyldiphenol compounds were incorporated into the topcoat formulation instead of the photothermographic emulsion formulation.

| | |
|---|---|
| MEK | 92 parts |
| PARALOID ® A-21 | 0.59 parts |
| CAB 171-15S | 6.4 parts |
| Vinyl sulfone VS-1 | 0.24 parts |
| KS-3 | 0.21 parts |
| Acutance Dye AD-1 | 0.09 parts |
| Antifoggant AF-B | 0.16 parts |
| DESMODUR ® N3300 | 0.48 parts |
| Tinting Dye TD-1 | 0.004 parts |
| Sulfonyldiphenol | See TABLE III |

The photothermographic materials were developed and evaluated as described in Example 1. A comparative sample, Sample 3-1-Comparative, was prepared containing no sulfonyldiphenol. The change in density at initial $D_{min}$, and the maximum density change after 3 hour Hot-Dark Stability Test for Sample 3-1-Comparative were each assigned a relative value of 100. Three inventive samples were prepared containing the sulfonyldiphenol compounds SDP-1 to SDP-3. The change in density at the initial $D_{min}$ and the maximum density change after 3 hour Hot-Dark Stability Test for the inventive samples are shown as ratios to Sample 3-1-Comparative in TABLE III.

The results, shown below in TABLE III, demonstrate that use of the inventive sulfonyldiphenol compounds improved post-processing hot-dark stability of the photothermographic materials. All inventive samples showed less change at initial $D_{min}$ and the maximum density change after 3-hour Hot-Dark Stability Test in comparison with the Sample 3-1-Comparative containing no sulfonyldiphenol. The results also demonstrate that the use of the sulfonyldiphenol compounds is effective not only in the photothermographic layer, but also in the topcoat layer, suggesting free diffusion of the compounds between layers in the photothermographic materials.

TABLE III

| Sample | Additional Compound | Amount of Additional Compound (mol/m$^2$) | Relative Change in Dmin | Relative Maximum Change in Density |
|---|---|---|---|---|
| 3-1-Comparative | None | 0 | 100 | 100 |
| 3-2-Inventive | SDP-1 | $3.1 \times 10^{-4}$ | 13 | 65 |
| 3-3-Inventive | SDP-2 | $3.1 \times 10^{-4}$ | 13 | 68 |
| 3-4-Inventive | SDP-3 | $3.1 \times 10^{-4}$ | 44 | 95 |

EXAMPLE 4

A photothermographic material was prepared and tested for Raw Stock Keeping in the following manner.

A photothermographic imaging formulation was prepared as described in Example 1 except for the following. The photothermographic emulsion formulation contained 3.8 parts of CAO5 and 7.5 parts of Irganox® 1010 reducing agents. The sulfonyldiphenol compounds were incorporated into the topcoat formulation instead of the photothermographic emulsion formulation.

Raw Stock Keeping (RSK) Test at Harsher Conditions:

Samples of the unprocessed film were packaged in a black polyethylene bag and stored in a chamber at 27° C. and 80% RH for the various times of 1, 1.5, and 2 months. The film samples were then imaged and processed as described in Example 1 above to obtain $D_{min}$ values. The relative change in $D_{min}$ ($\Delta D_{min}$) was calculated by subtracting the initial $D_{min}$ from the $D_{min}$ of the sample after Raw Stock Keeping test. The results are shown below in TABLE IV.

TABLE IV

| Sample | Additional Compound | Amount of Additional Compound (mol/m$^2$) | Initial $D_{min}$ | $\Delta D_{min}$ (1 month RSK) | $\Delta D_{min}$ (1.5 month RSK) | $\Delta D_{min}$ (2 month RSK) |
|---|---|---|---|---|---|---|
| 4-1-Comparative | None | 0 | 0.223 | 0.020 | 0.049 | 0.070 |
| 4-2-Inventive | SDP-1 | $3.1 \times 10^{-4}$ | 0.221 | 0.016 | 0.032 | 0.040 |

The results shown in TABLE IV demonstrate that the incorporation of the inventive compound SDP-1 improves the raw stock keeping $D_{min}$ stability of the photothermographic materials under harsher conditions such as high temperature and high humidity.

The invention has been described in detail with particular reference to certain preferred embodiments thereof, but it will be understood that variations and modifications can be effected within the spirit and scope of the invention.

The invention claimed is:

1. A black-and-white photothermographic material comprising a support having on at least one side thereof, one or more photothermographic imaging layers comprising in reactive association:

a. a photosensitive silver halide, b. a non-photosensitive source of reducible silver ions, c. a reducing agent for said reducible silver ions, and d. a polymeric binder, said material further comprising a sulfonyldiphenol in an amount of at least 0.01 mmol/$m^2$.

2. The material of claim 1 having layers coated out of organic solvents and said polymeric binder is a hydrophobic binder.

3. The material of claim 1 wherein said sulfonyldiphenol is a 4,4'-sulfonyldiphenol that is represented by the following Structure (SDP):

(SDP)

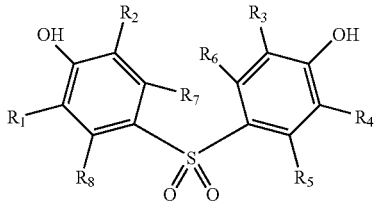

wherein $R_1$ through $R_8$ are independently hydrogen or halo, alkyl, alkoxy, cyano, nitro, trihaloalkyl, ester, ketone, or haloalkyl groups.

4. The material of claim 3 wherein $R_1$ through $R_8$ are independently hydrogen or bromo, chloro, methyl, or ethyl groups.

5. The material of claim 3 wherein $R_1$ through $R_4$ are independently hydrogen or bromo, chloro, methyl, or ethyl groups, and each of $R_5$ through $R_8$ is hydrogen.

6. The material of claim 1 wherein said sulfonyldiphenol is present in an amount of from about 0.05 to about 6 mmol/$m^2$.

7. The material of claim 1 wherein said sulfonyldiphenol is one or more of the following Compounds SDP-1 through SDP-3:

SDP-1

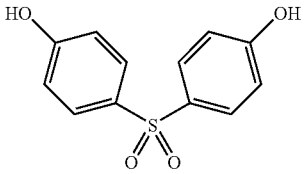

-continued

SDP-2

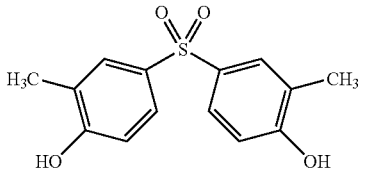

SDP-3

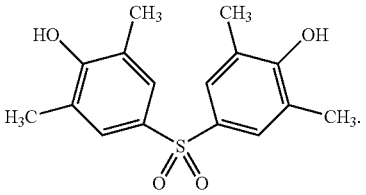

8. The material of claim 1 further comprising a high contrast enhancing agent, co-developer, or both.

9. The material of claim 8 wherein said high contrast enhancing agent or co-developer is a substituted acrylonitrile compound, a trityl hydrazide or formyl phenyl hydrazide, substituted isoxazole, substituted malondialdehyde, cyclic enol, hydroxylamine, alkanolamine, ammonium phthalamate, hydroxamic acid, N-acylhydrazine, or hydrogen atom donor compound.

10. The material of claim 1 wherein the total amount of silver is less than 1.9 g/$m^2$.

11. The material of claim 1 wherein said silver halide is present as silver bromide or silver iodobromide grains having an average grain size of from about 20 to about 60 nm.

12. The material of claim 1 further comprising a protective overcoat layer disposed over said photothermographic layer, and interlayer, carrier layer, or any combination thereof, wherein any of the protective overcoat layer, interlayer, and carrier layer includes said sulfonyldiphenol.

13. The material of claim 1 wherein said sulfonyldiphenol is present in an amount of from about 0.05 to about 2 mmol/$m^2$.

14. The material of claim 1 wherein said reducing agent is a mixture of two or more hindered monophenol reducing agents, hindered bisphenol reducing agents, and hindered trisphenol reducing agents.

15. The material of claim 1 having a total silver coverage of from about 1 to about 2.6 g/$m^2$.

16. The material of claim 1 wherein said sulfonyldiphenol is

SDP-1

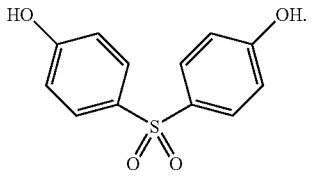

17. A method of forming a visible black-and-white image comprising:

A) imagewise exposing the photothermographic material of claim 1 to electromagnetic radiation to form a latent image, and B) simultaneously or sequentially, heating said exposed photothermographic material to develop said latent image into a visible image.

18. The method of claim 17 wherein said imagewise exposing is carried out using laser imaging at from about 600 to about 1200 nm and said development is carried out for 20 seconds or less.

19. The method of claim 17 wherein said sulfonyldiphenol is a 4,4'-sulfonyldiphenol that is present in an amount of from about 0.05 to about 6 mmol/$m^2$, and is represented by the following Structure (SDP):

(SDP)

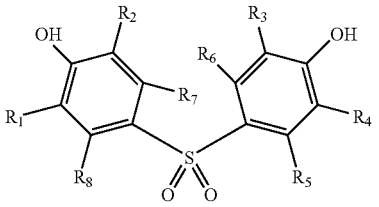

wherein $R_1$ through $R_8$ are independently hydrogen or halo, alkyl, alkoxy, cyano, nitro, trihaloalkyl, ester, ketone, and haloalkyl groups.

20. The method of claim 17 wherein said photothermographic material comprises a 4,4'-sulfonyldiphenol that is

SDP-1

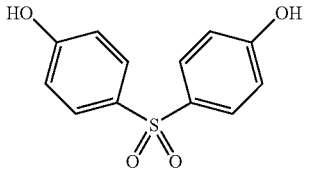

and is present in an amount of from about 0.05 to about 6 mmol/$m^2$.

* * * * *